US007931077B2

(12) United States Patent
Rudshaug et al.

(10) Patent No.: US 7,931,077 B2
(45) Date of Patent: Apr. 26, 2011

(54) TOP DRIVE DRILLING APPARATUS

(75) Inventors: Bjørn Rudshaug, Kristiansand (NO); Dag Håverstad, Nodeland (NO)

(73) Assignee: Aker Kvaerner MH AS, Kristiansand (NO)

( * ) Notice: Subject to any disclaimer, the term of this patent is extended or adjusted under 35 U.S.C. 154(b) by 267 days.

(21) Appl. No.: 12/085,673

(22) PCT Filed: Dec. 4, 2006

(86) PCT No.: PCT/NO2006/000457

§ 371 (c)(1), (2), (4) Date: May 29, 2008

(87) PCT Pub. No.: WO2007/064231

PCT Pub. Date: Jun. 7, 2007

(65) Prior Publication Data

US 2009/0084537 A1 Apr. 2, 2009

(30) Foreign Application Priority Data

Dec. 2, 2005 (NO) ..... 20055709

(51) Int. Cl.
*E21B 19/00* (2006.01)

(52) U.S. Cl. ..... 166/77.52; 175/162; 175/202; 175/203

(58) Field of Classification Search ..... 166/77.51, 166/77.52; 175/162, 202, 203, 220
See application file for complete search history.

(56) References Cited

U.S. PATENT DOCUMENTS

| | | | | |
|---|---|---|---|---|
| 4,593,773 | A | 6/1986 | Skeie | |
| 4,791,999 | A | 12/1988 | Skeie | |
| 4,813,493 | A | 3/1989 | Shaw et al. | |
| 4,878,546 | A | 11/1989 | Shaw et al. | |
| 2005/0279507 | A1 * | 12/2005 | Folk et al. | 166/378 |
| 2009/0166090 | A1 * | 7/2009 | Rudshaug et al. | 175/85 |

FOREIGN PATENT DOCUMENTS

| | | |
|---|---|---|
| EP | 0162000 | 11/1985 |
| EP | 0196284 | 7/1990 |
| NO | 154578 | 7/1985 |
| NO | 15553 | 1/1987 |
| WO | 8907188 | 8/1989 |

OTHER PUBLICATIONS

International Search Report for PCT/N02006/000457, mailed Mar. 14, 2007.

Norway Search Report Norway Application No. 20055709, dated Jun. 12, 2006.

International Preliminary Report on Patentability with Written Opinion issued on Jun. 12, 2008 in International Application No. PCT/N02006/000457.

* cited by examiner

*Primary Examiner* — Giovanna C Wright
(74) *Attorney, Agent, or Firm* — Nixon & Vanderhye PC

(57) ABSTRACT

A well drilling apparatus (10') (top drive) designed to be suspended from a travelling block (6') in a drawworks and laterally supported by a dolly (9') running together with the well drilling apparatus along tracks or rails fixed to a derrick. The drilling apparatus (10') comprises at least one driving motor (5'), one power transmission (4') powered by the at least one driving motor (5'), a drive shaft (70) driven from the power transmission (4') and designed to be connected to a drill string, load transferring means, and a torque arresting device (3') fixed to and depending from the power transmission (4'). The load transferring means is in the form of a load frame module (1') that relieves the drive shaft (70) and the power transmission (4') at the same time as the load frame module (1') forms a central component module that the other main components of the well drilling apparatus are releasable connected to.

15 Claims, 23 Drawing Sheets

TOP DRIVE DRILLING APPARATUS

CROSS-REFERENCE TO RELATED APPLICATIONS

This application is the U.S. national phase of International Application No. PCT/NO2006/000457, filed 4 Dec. 2006, which designated the U.S. and claims priority to Norway Application No. 2005 5709, filed 2 Dec. 2005, the entire contents of each of which are hereby incorporated by reference.

BACKGROUND OF THE INVENTION

The present invention relates to a well drilling apparatus designed to be suspended from a traveling block in a drawworks and laterally supported by a dolly running together with the well drilling apparatus along tracks or rails attached to a derrick, which well drilling apparatus comprises at least one driving motor, one power transmission powered by the at least one driving motor, a drive shaft driven from the power transmission and designed to be connected to a drill string, load transferring means, and a torque arresting device attached to and depending from the power transmission.

Well drilling machines that are able to move up and down in a derrick on board a vessel were seriously taken in use in the second half of the nineteen eighties. Till then it had been usual with a rotary table on the drill floor in order to rotate a drill string. The main function of such a drilling machine is to perform the very drilling operation. By this is meant to rotate the drill sting by a given rotational speed and a given torque in order to drill an oil and gas well. The drill string is assembled by a number of pipe elements and can have a length from 300 to 15000 meters.

As the well bore has reached continuously greater depths, the loads and strains within the drilling machines have increased in concert with this. Some kind of development has taken place through the years, but the main concept is in large extent the same as the original one.

Now a totally new generation top drive drilling machine is provided that will ensure stable and continuous operation in far grater extent than before, also during drilling of the continuously deeper wells. In addition to be more sturdy, the new drilling machine will also have the advantage that necessary maintenance work can be performed in a much shorter time than what has been the case with prior art drilling machines.

Examples of the prior art machines are shown and described in NO 155553 and NO 840285.

In such prior art designs the main structural elements consist of an encapsulation of the main thrust bearing, a main shaft having a bolted on load carrying shoulder, and a reduction gear transmission. This means that the load path, i.e. the interconnection between the drilling machine and the drawworks, takes place through the main thrust bearing and the transmission. A breakdown in any of these complicated mechanical components entails complete disassembly of the machine. Normally the most complicated mechanical element is used as main load carrying component. This takes a long time to maintain and represents downtime for the drilling operations of the rig.

This is attempted clarified in table 1, that shows the mutual interconnection of the main components of the prior art solution, i.e. which components that have interface to each other.

BRIEF SUMMARY OF THE INVENTION

By repeal of function for the drilling machine the basis of income for the drilling vessel is annulled. For this reason the repair time for a drilling machine is very critical, and the present invention has as a substantial object to reduce the repair time and increase the repair intervals.

According to the present invention a well drilling apparatus of the introductory mentioned kind is provided, which drilling apparatus is distinguished in that the load transferring means is in the form of load frame module that relieves the drive shaft and power transmission at the same time as the load frame module forms a central component module that the other main components of the well drilling apparatus are releasable connected to.

In one preferable embodiment the load frame module is in the form of a maintenance free structural element, preferably omit any moving parts. For example, it may be cast in one piece of iron or other suitable structural material.

The load frame is preferably oversized so that the likelihood for fatigue fracture or other type of load conditional fracture is eliminated. By introducing this load frame, a key element is created for other modules like the main shaft and main bearing module, adapter module for adaptation to different types of vessels, dolly for the drilling apparatus, water cooled AC motor module (one or two) and the reduction gear transmission unit.

The load frame module can carry the transmission and the transmission can constitute a component module which is releasable from the load frame by means of releasable coupling means, preferably quick release coupling means.

Further, the transmission can carry the at least one driving motor and each driving motor can constitute another component module which is releasable both from the transmission and the load frame by means of releasable coupling means, preferably quick releasable coupling means.

Further, the transmission can carry the torque arresting means, which can constitute another component module which is releasable from the transmission by means of releasable coupling means, preferably quick releasable coupling means.

Thus it is to be understood that the architecture of the machine is substantially changed relative to the prior art. In addition to the advantages as described above, the machine is arranged and adapted for rapid replacement of the main components. In order to accomplish this, which also is a substantial difference that distinguish the new drilling machine concept from the prior art, is the subdivision of the construction elements of the machine, i.e. modules which with a minimum of effort is able to separate the machine into larger components with the aim to reduce the time for disassembly/assembly during maintenance work and repair.

The coupling means can be hydraulic operated bolts and nuts or manually operated bolt and nuts.

The drilling apparatus can further include a swivel for transfer of mud or liquid from a stationary place to the rotating drill string, where the swivel is connected to the drive shaft and form together a swivel module which is releasable from the load frame by means of quick releasable coupling means.

The swivel may in turn be in connection and fluid communication with the drill string via a shaft stub having at least one internal safety valve, preferably also at least one redundant valve in addition.

The drilling apparatus may also include an elevator mechanism having an elevator for manipulating the drill string/pipe string.

As it will be understood, the mutual interconnection of the component modules is now focused around the load frame. This means that previous complicated operations for disassembly and maintenance gets substantially reduced extent.

This is further visualized in table 2 which shows the interface between the different components of the new drilling machine.

With reference to table 1 and 2 it appears that there are differences between the two tables. Listed modules are as follows: Load frame; previously described as the maintenance free structural element which connect the various modules together. The travelling block adapter; that part of the load train that connects the standardized load frame against various embodiments of travelling blocks on different drilling vessels. Instrumentation and in/out module for signals; the module which converts all signals from analogue to digital signals that only require one single cable. The significant content of this table shows that a non-maintenance demanding structural element, i.e. the load frame, has taken over the load carrying in stead of the traditional swivel and transmission that both were maintenance demanding and required frequent replacement.

With the previous prior art, it is not taken particular reservation to ease the maintenance or replacement of larger units on board the installation. The presumption for heavier maintenance has traditionally been that the entire machinery is transported to shore. Smaller components, like rotatable seals, are previously optimized for rapid replacement. The differences thus mostly pertain for the larger units.

BRIEF DESCRIPTION OF THE DRAWINGS

Other and further objects, features and advantages will appear from the following description of the invention, which are given for the purpose of description in context with the appended drawings where.

DETAILED DESCRIPTION OF THE INVENTION

Table 1 on side 26 shows an oversight over which components make interface with each other in the prior art drilling apparatus, and tell something about the number of components that need to be disassembled in order to create access during maintenance.

Table 2 on side 27 shows an oversight over those components in the new drilling apparatus according to the invention that have a common interface.

Figure 1:
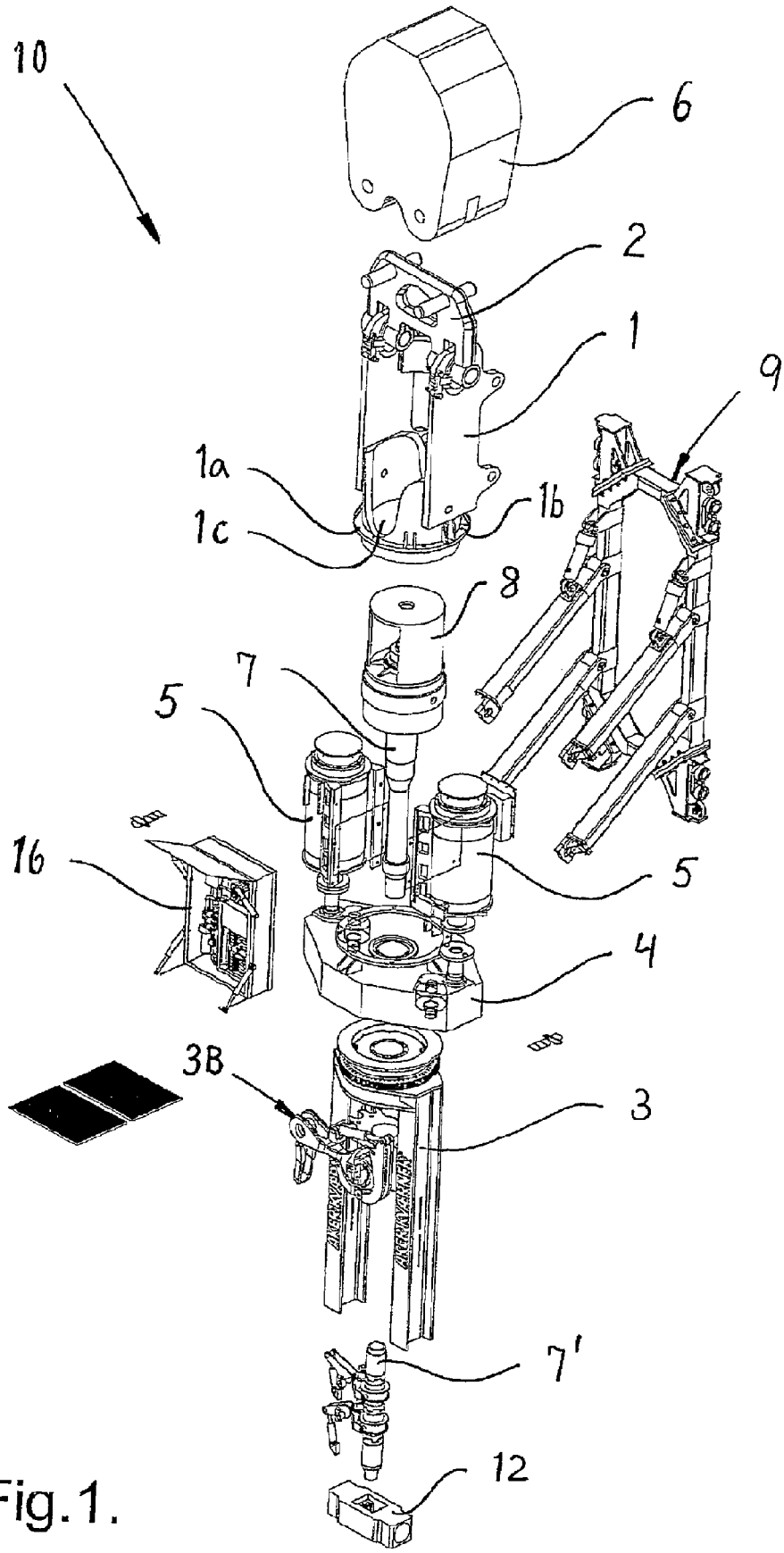
FIG. 1 shows an exploded, perspective view of the drilling machine according to the invention.
Figure 2:
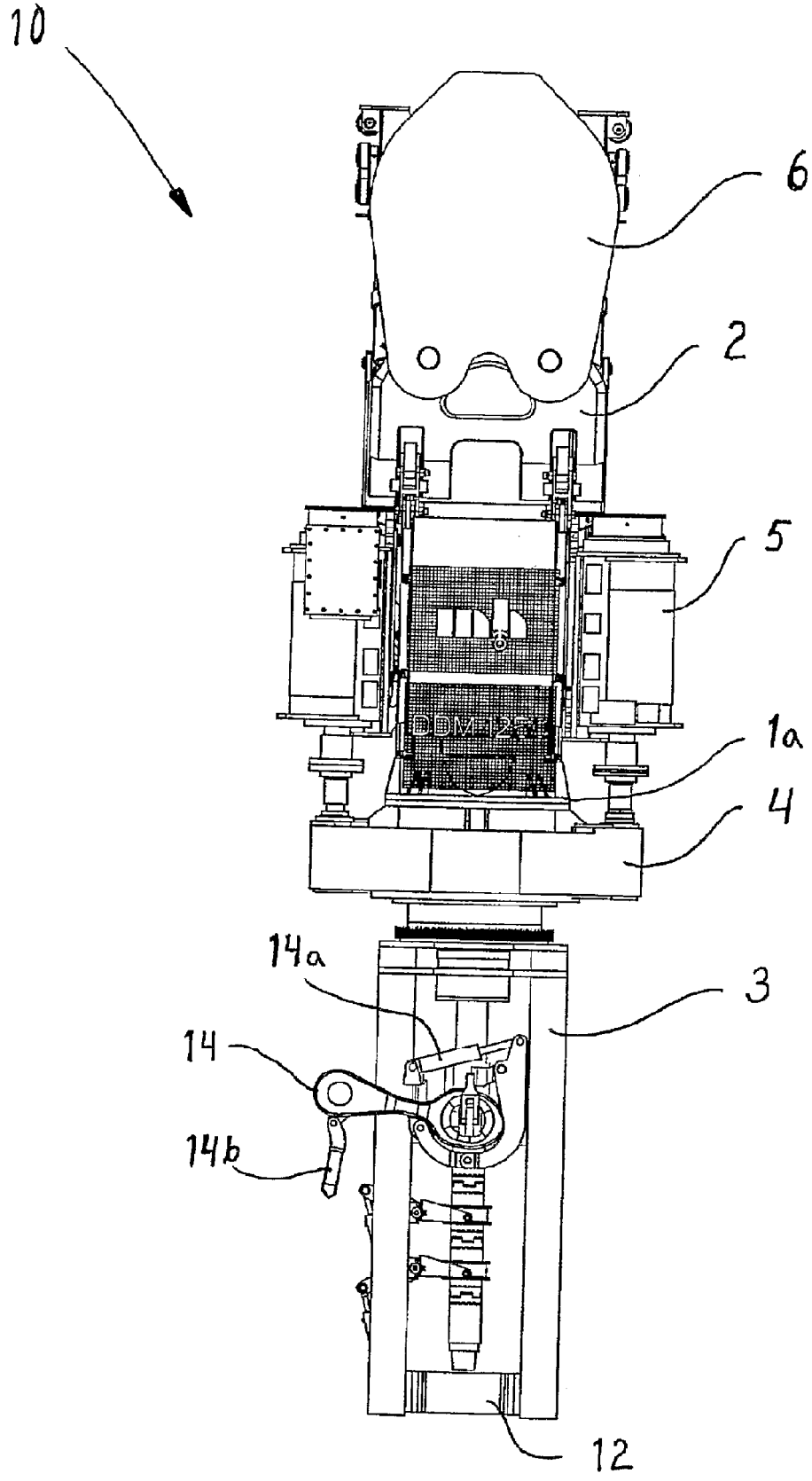
FIG. 2 shows a front view of the drilling machine depicted in FIG. 1.
Figure 3:
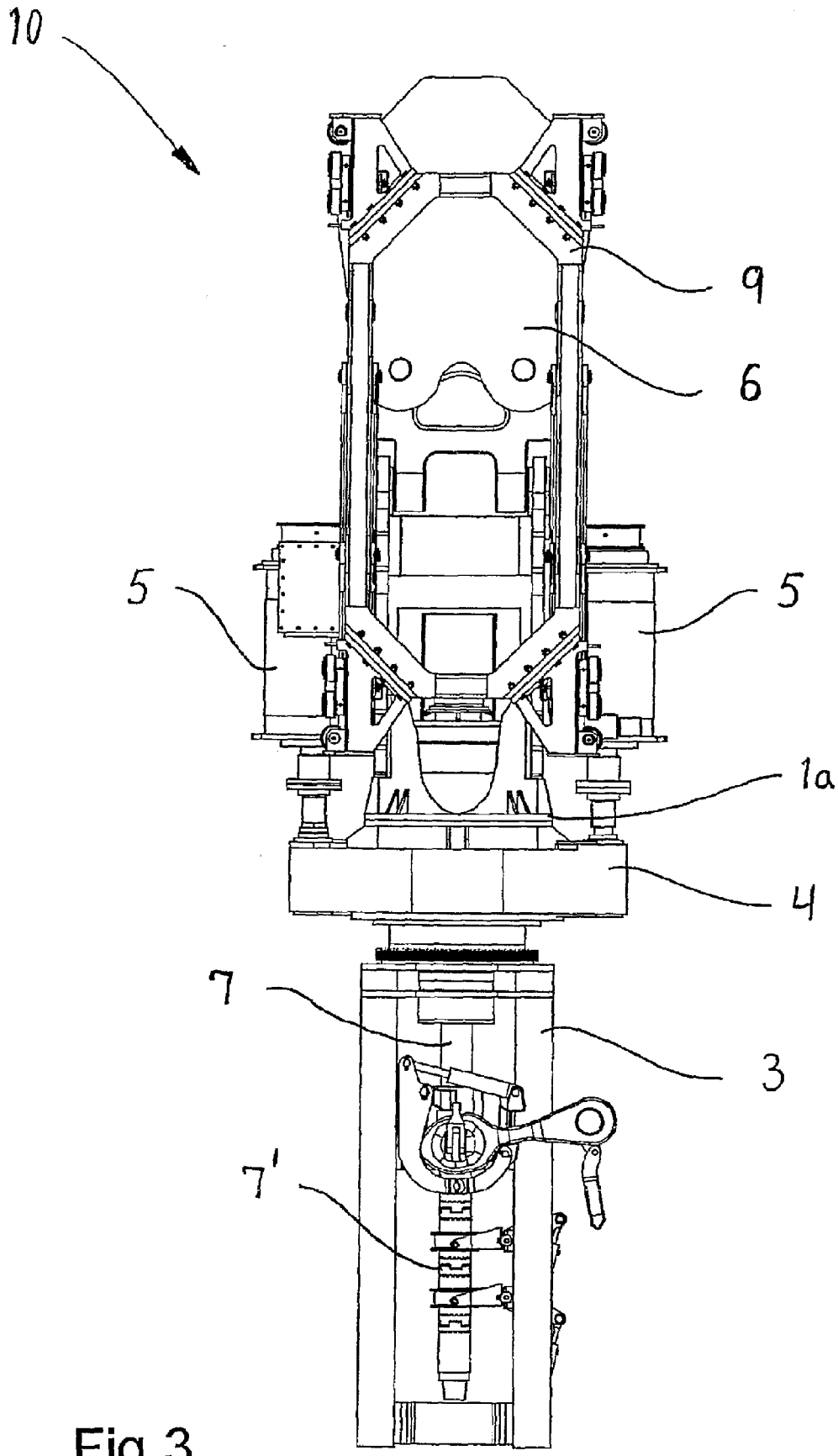
FIG. 3 shows a rear view of the drilling machine depicted in FIG. 1.
Figure 4:
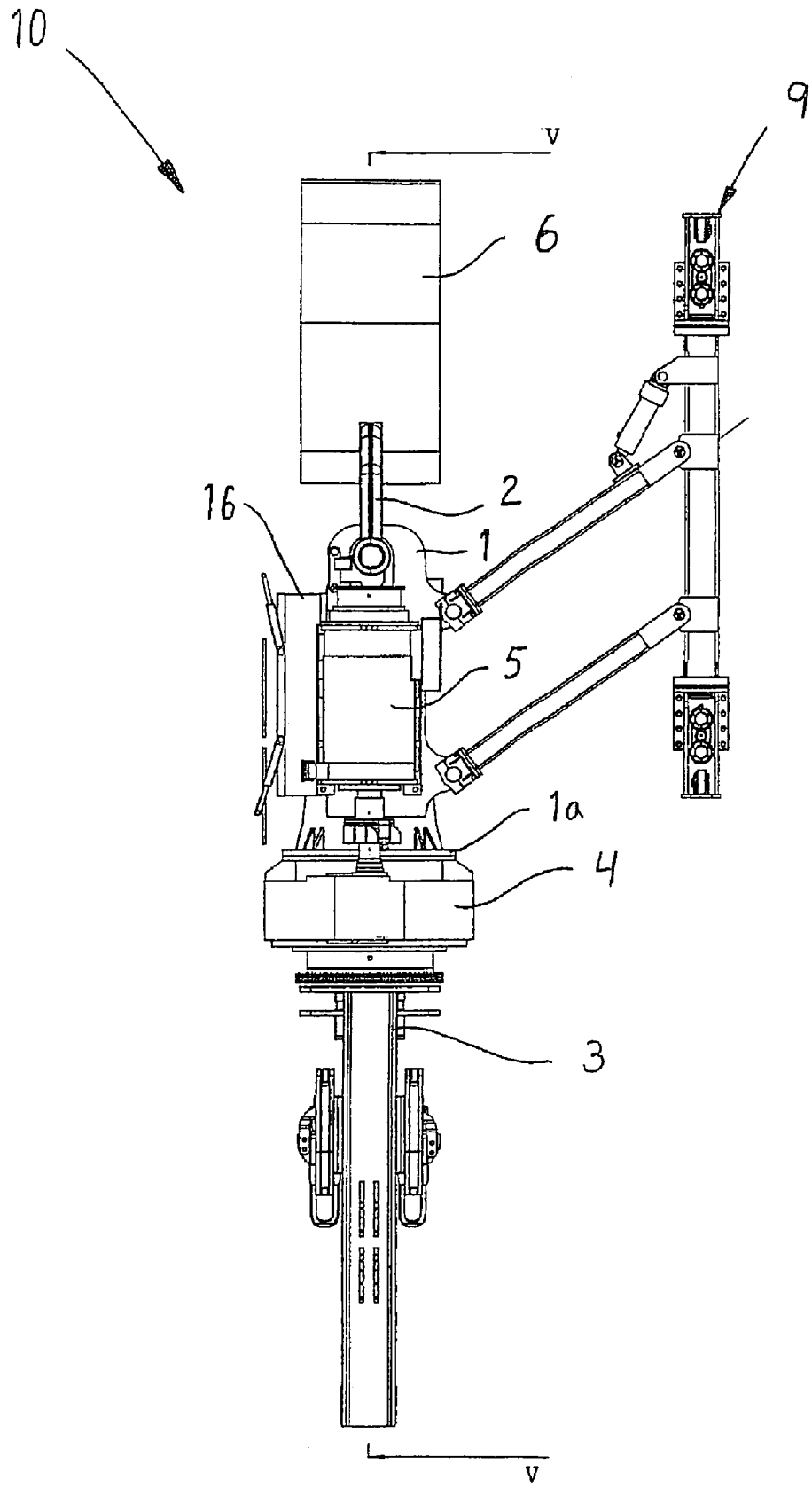
FIG. 4 shows a side view of the drilling machine depicted in FIG. 1.

Reference is now made to FIG. 1 which shows the new modularly constructed drilling machine 10 with the parts separated from each other, and FIG. 2-4 that show the assembled drilling machine 10. The drilling machine 10 is designed to be suspended in a pulley block 6 in a drawworks arranged in a derrick (not shown) on board a vessel performing offshore drilling activity. The drilling machine 10 is guided by a dolly 9 running along rails attached to the derrick. The drilling machine 10 turns drill pipes around a drilling axis to drill an oil and gas well in the sea bed. With reference to FIGS. 1-6, the drilling machine 10 will firstly be described in broad outline, i.e. the construction of the main components thereof. A more detailed description of the internal components will follow with reference to the FIGS. 7-17. Relative positioning terms as "upper", "lower", "vertical", "horizontal" and "drilling axis" are related to a drilling machine in activity. It is also to be understood that the drilling machine 10 consists of many functional details which are not described in detail here. In order to that the description shall not be too detailed and complex, it is confined to the main components and the interactions thereof.

With reference to FIG. 1, an adapter 2 for adaptation to different types of vessels is located uppermost and adjacent to the pulley (travelling) block 6. The adapter 2 is releasable attached to the pulley block 6 at the same time as it also is releasable connected to a below located load frame 1. The load frame 1 has among other factors the task to relieve axial loads in the drive shaft of the drilling machine 10. The load frame 1 is also a central element regarding the modular construction of the drilling machine 10. The other component modules are built up around the load frame 1. The load frame module 1 is suitably made and constructed as a maintenance free structural element, preferably without any moving parts.

It may for example be molded of iron in one piece or of any other suitable structural material, but, as mentioned, omit maintenance.

A valve and instrument cabinet 16 is attached to the load frame 1 and is pivotal attached in order to easier get access to a rotary seal behind the cabinet.

At its lower end the load frame module 1 is connected to a power transmission module 4. The way the power transmission module 4 is attached to the load frame module 1 is particular in that quick coupling means preferably are used, such as hydraulic bolts and nuts. The bolts can, for example, be fixedly attached to the power transmission housing and project upwardly. The lower part of the load frame 1 has a flange 1*a* with bolt holes 1*b* that correspond with said bolts. During assembly, the load frame 1 is oriented and is treaded down over the hydraulic, upwards projecting bolts before final assembly by nuts that are screwed by "finger force" onto said bolts till abutment against the load frame flange 1*a* before the bolts are relieved for their hydraulic pressure. However, it is still not any presumption that the means are quick coupling, even if it is preferred with respect to necessary use of time during disassembly/assembly. Also traditional bolts and nuts can be used, possibly other suitable fixing means.

With reference to FIG. 1-6, two main driving motors 5 are arranged on the power transmission module 4 in the illustrated embodiment. Preferably, the driving motors 5 are diametrically located relative to the drilling axis of the drilling machine 10. By such location they counterbalance each other with regard to forces and torques when both motors 5 are in activity. However, it is still to be noted that the driving motors 5 are so dimensioned that drilling activity can be performed with only one of the driving motors 5 in action. Each driving motor 5 is easily and quick releasable from the power transmission module 4 and the load frame module 1.

Each driving motor 5 is non-rotatable fixed to respective sides of the vertical parts of the load frame 1. The way the driving motors 5 are fixed has quick mounting/dismounting operation as a major criterion. The load frame 1 has respective sliding rails attached to the said vertical parts. The profile is in the form of an angle projecting outward. Correspondingly the driving motors 5 have respective complementary rails attached thereto which fit with the rails on the load frame 1. In addition the rails are on at least one of the parts slightly inclined so that a wedging action is obtained during assembly of the parts.

Figure 8:
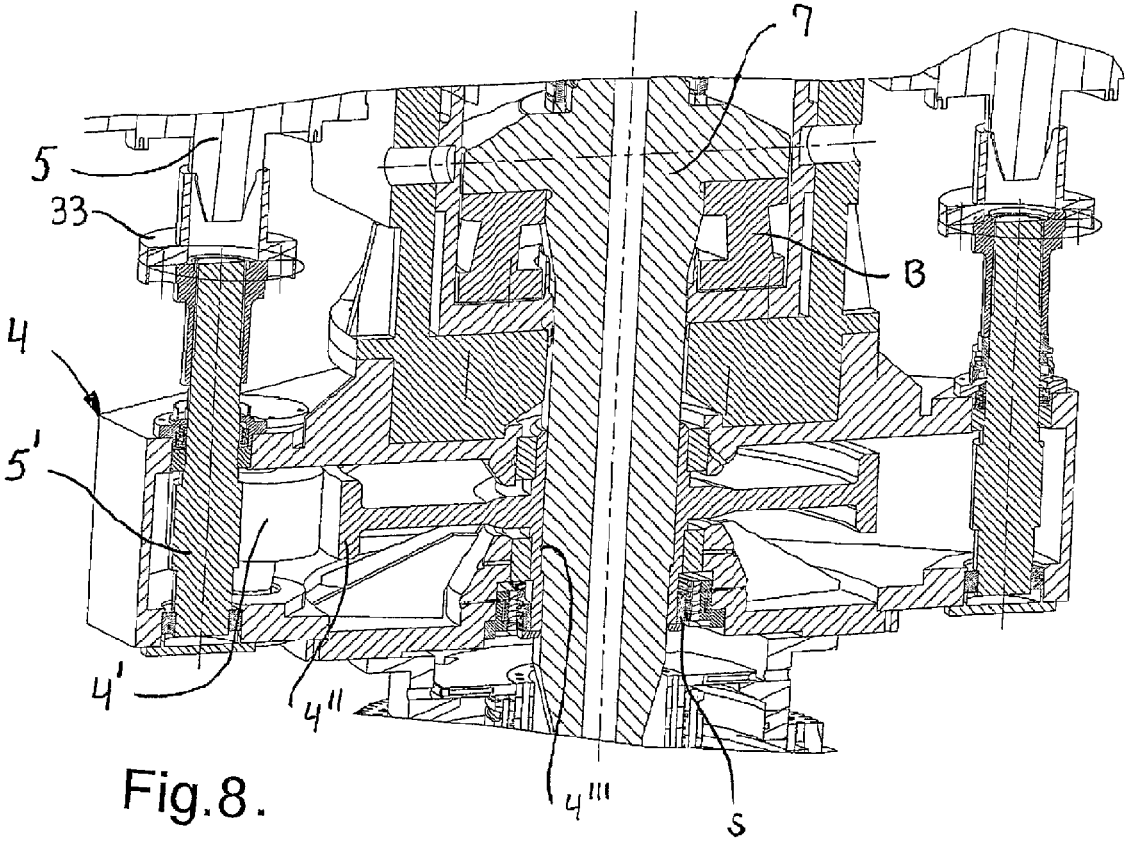
FIG. 8 shows a longitudinal section through the transmission and adjoining parts.

Each driving motor 5 has a pinion gear 5' in the lower end thereof, which via an idler gear 4' is in mesh with a gear rim 4" of substantial diameter, see FIG. 8. The gear rim 4" has a central hole having splines 4''' designed to cooperate with axially extending splines in the drive shaft 7 for rotational power transmission. The transmission structure provides a reduction power transmission.

The drive shaft 7 is also connected to an above located swivel (not shown on the figure). The swivel is a device for being able to transfer liquid, in this case mud, from a stationary part to a rotating part like the drive shaft 7 in this case. The swivel has an enclosing housing 8 and various seals which will be described in detail later. The lower end of the swivel housing 8 is abutting against a bottom plate 1*c* in the load frame 1 and is further non-rotatable attached to the load frame 1 as illustrated in the figure and having apertures cut out in the swivel housing 8 and the side wall of the load frame 1. It can, however, in a quick and easy way be released from each other during a maintenance operation. Actually, they are standing stable relative to each other without such fixing means. The upper end of the drive shaft 7 is placed within the swivel housing. A main bearing B is located between a ring flange on the drive shaft 7 and said bottom plate 1*c* in the load frame 1. This is shown in detail in FIGS. 8 and 15.

The main load path is now, distinct from the prior art, totally independent of the reduction power transmission. The load picture that the reduction power transmission is subjected to is now conditional on the dead weight of the transmission and a below attached pipe handler unit 3. This implies that less comprehensive mechanical attachment means can be used compared with previous solutions.

In order to maintain the idea about the "modular" and the "quick releasable" as a read line through the entire new concept, preferably fastening means having a quicker operation possibility than bolts having a threaded end and corresponding nut are used. Preferred solution is, as already mentioned, based on hydraulic operation. Hydraulic operation implies that a bolt shaped structural element is tensioned to desired preload by use of a hydraulic pump and a cylinder arrangement, whereupon a mechanical locking means keeps the bolt with the desired preload relative to the two surfaces that are to be kept together. This is analogue with that preload which is created when a nut is tightened over a threaded portion having a given thread pitch, but the procedure is far quicker.

Figure 5:
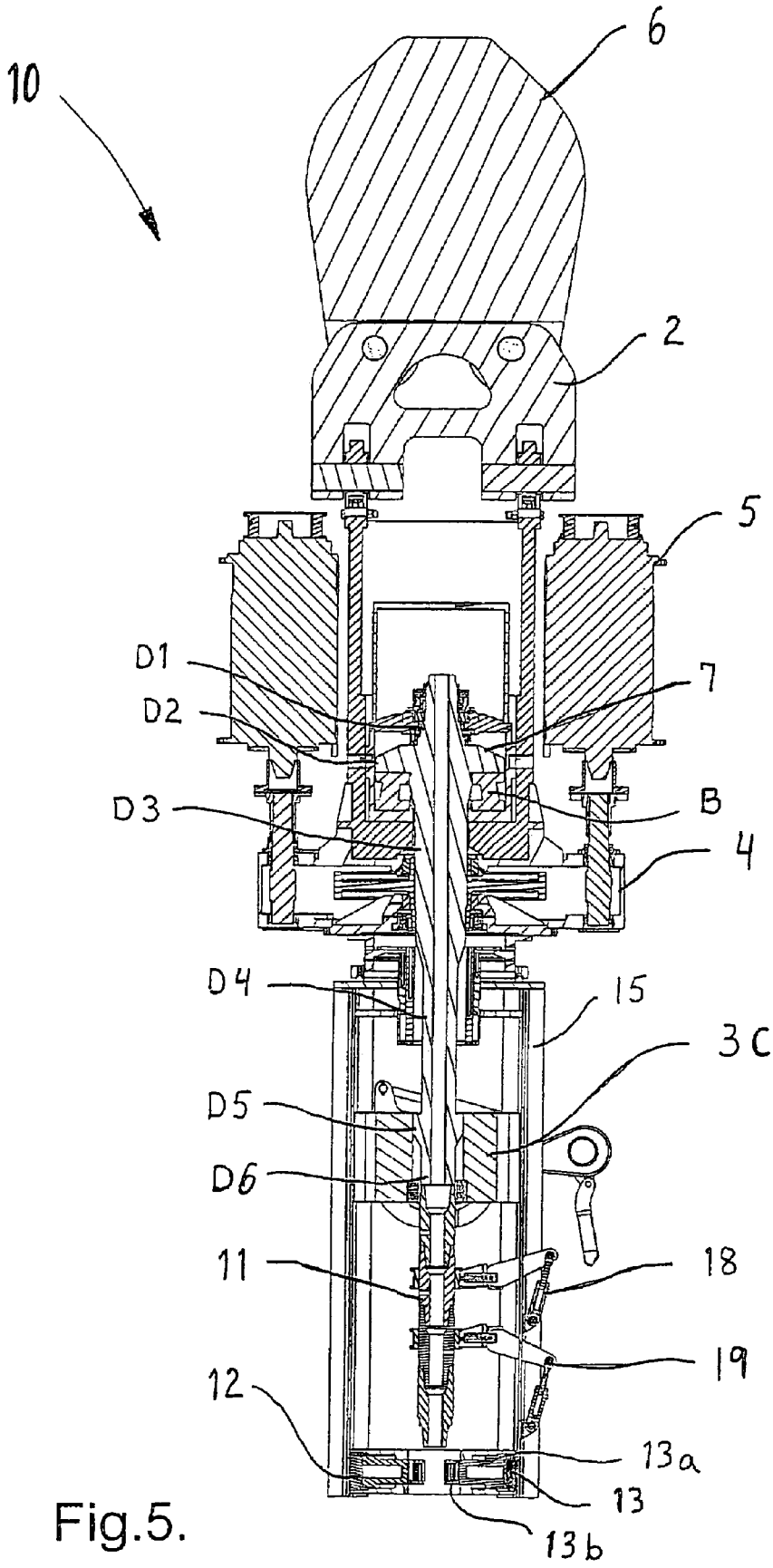
FIG. 5 shows a longitudinal view along line V-V in FIG. 4.
Figure 6:
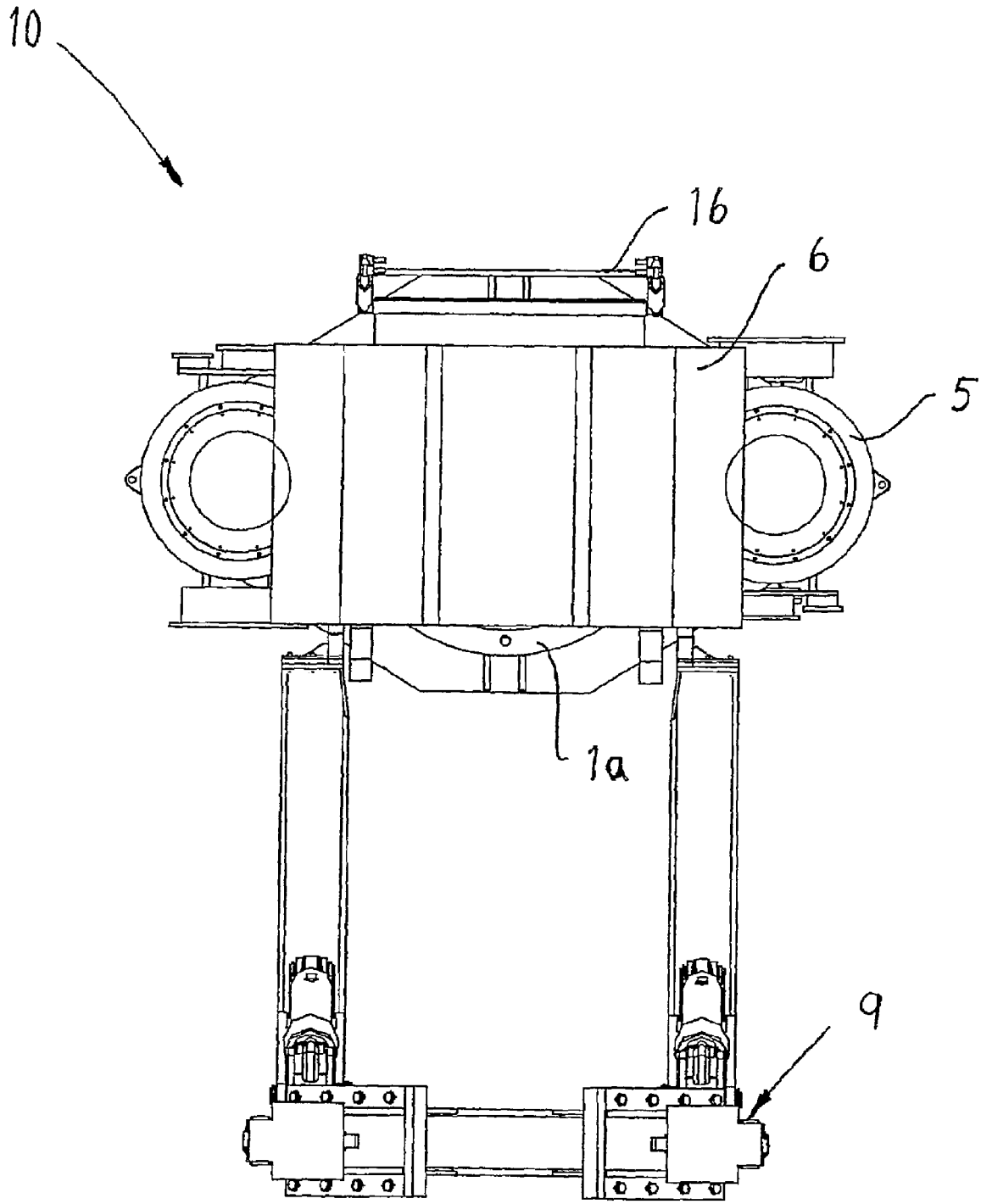
FIG. 6 shows a top view of the drilling machine depicted in FIG. 1.
Figure 7A:
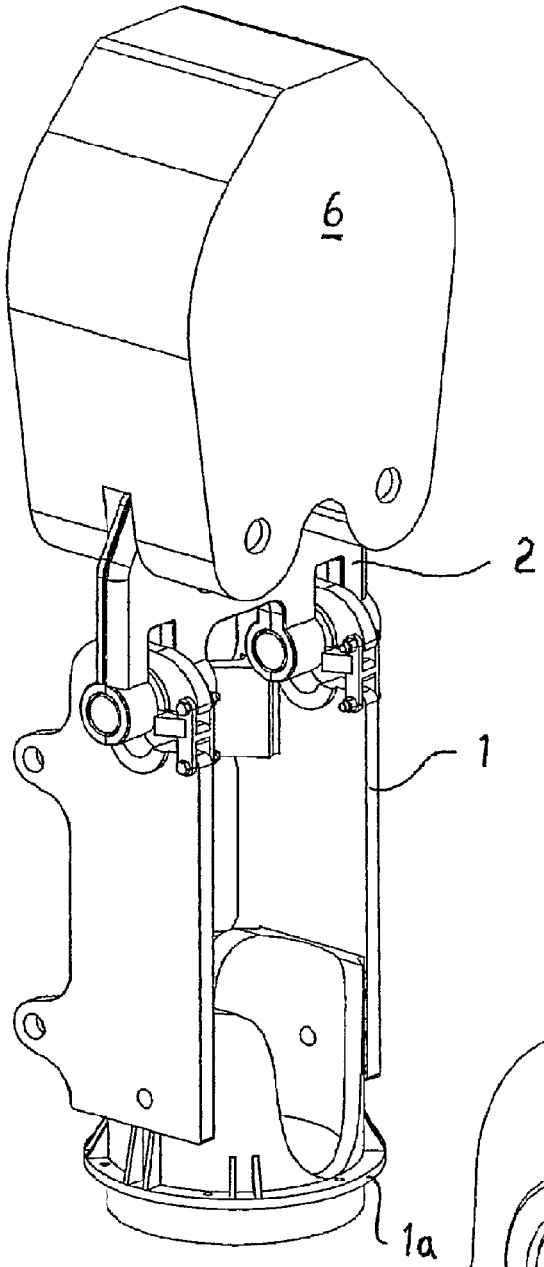
FIG. 7A shows the load frame module together with the travelling block adapter and the travelling block in closer detail.
Figure 7B:
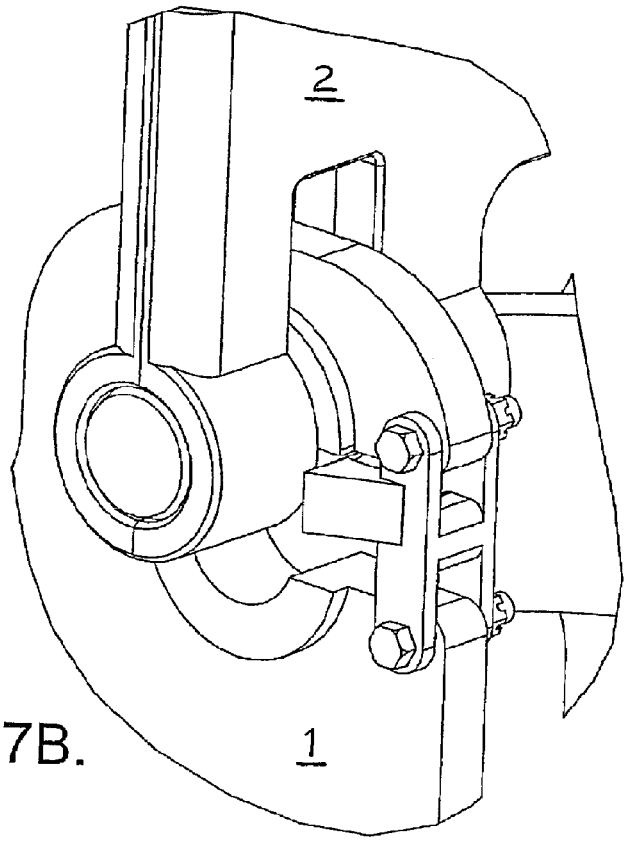
FIG. 7B shows a securing detail between the load frame module and the travelling block adapter.

The drive shaft 7 has received a totally new design compared with previous drive shafts for top drive drilling machines, see in particular FIG. 5. The new drive shaft 7 has six main diameters referred to as D1 to D6 in FIG. 5. D1 is fitted with an upper control bearing. D2 is equal to or somewhat bigger than the outer diameter of the main bearing. D3 is somewhat bigger than D5. D4 is smaller than D3 and D5. D6 is controlled by the standard of the actual threaded shaft stub that connects the rotary drive shaft 7 by the drill string itself. D3 has the above mentioned axial splines in its surface, a so-called "DIN-ISO Spline", which correspond with the corresponding splines in the centre hole of the gear rim in the reduction power transmission 4.

In order to be able to pull the drive shaft 7 through the transmission 4 during a maintenance operation, it is therefore important that D5 is smaller than D3, but simultaneously D5 needs to have sufficient difference from D4 so that the resulting surface becomes big enough to take care of the surface forces from a below located pipe handler assembly 3.

The pipe handler assembly 3 is attached to the lower side of the transmission 4, suitably by means of quick release means as previously described. For example, the bolts can be fixedly connected to the transmission housing and projecting downwards. The upper part of the pipe handler assembly 3 has a flange with bolt holes that correspond with said bolts. During assembly, the pipe handler assembly 3 is oriented and is treaded up over the hydraulic downwards projecting bolts before final fixation with nuts that are screwed with "finger force" onto said bolts until abutment against the flange on the pipe handler assembly 3, before the bolts are relieved from their hydraulic pressure. The bolts can also be in the form of pin bolts. It is nevertheless any presumption that the means are quick releasable, even if it is preferred with regard to necessary use of time during disassembly/assembly. Also traditional bolts and nuts can be used, possibly other suitable fastening means.

On top of the pipe handler assembly 3 a gear rim 3*a* that can be operated by an auxiliary motor (not shown) is arranged. The auxiliary motor is able to turn the pipe handler assembly 360° around and able to lock the assembly in any rotary position. The pipe handler device 3B itself has a pair of parallel extending links 14, see for example FIG. 2, that can be maneuvered by respective working cylinders 14*a*. At the end of the links 14 shackles or similar are provided which in turn carry depending arms 14*b* which together carry a pipe clamp (not shown) in the lower ends thereof. The pipe clamp is adapted to be able to enclose a pipe end to be able to carry a tubular element. The pipe clamp can, by means of the working cylinders 14*a*, be manipulated in and out of drill centre. During a regular drilling operation the pipe clamp is put aside of the drill centre. The complete unit is normally called an elevator.

The pipe handler assembly 3 has as object to form a secondary, non-rotatable load path, something that makes possible the use of the drilling machine 10 as a more conventional lifting equipment. For these lifting tasks some special equipment is developed, in order to effectively be able to handle different tubular items. The pipe handler assembly 3 is separate from the remaining parts of the drilling machine 10 and may as mentioned rotate 360 degrees independently of the drilling machine 10.

As mentioned this rotation is run by an auxiliary motor (not shown), being hydraulic or electric, with gear wheel that cooperate with the gear rim 3*a* on the pipe handler assembly 3. The pipe handler assembly 3 can be locked in any given position, either by a braking device in association with the auxiliary motor or simply a bolt that can be radially pushed in through the pipe handler assembly 3 and be locked against the rest of the drilling machine 10.

Figure 16A:
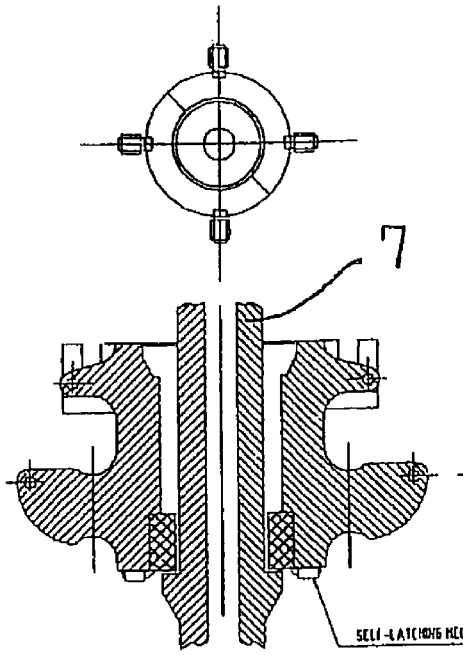
FIGS. 16A-16B show the connection between the drive shaft and a load shoulder in closer detail.
Figure 16B:
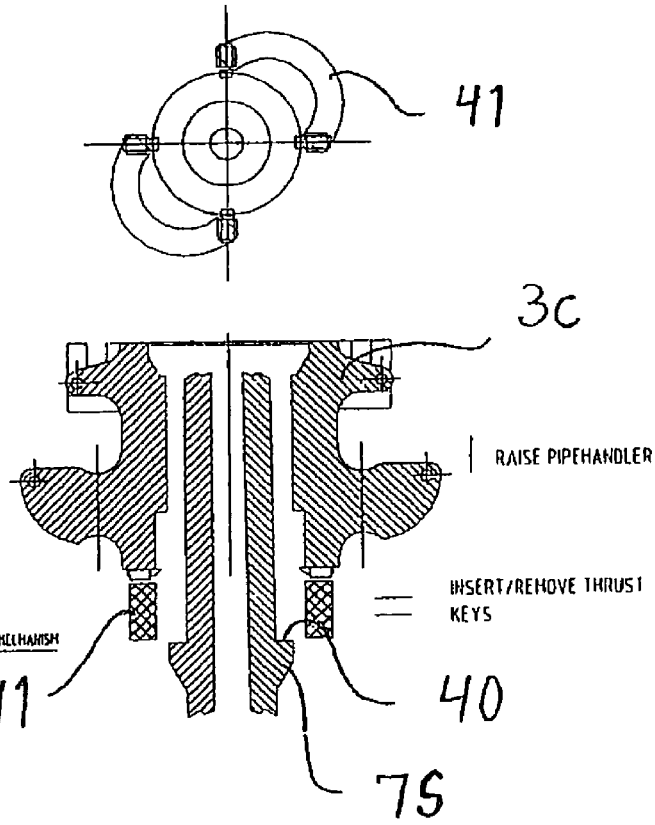

With reference to FIGS. 5, 16A and 16B, the pipe handler assembly 3 has two main objects that can be characterized in different load regimes, one light and one heavy. In the light load regime, which is typically upwardly limited to 15 metric tons, the pipe handler device 3B is lifted clear of a load shoulder 7S on the drive shaft 7 by means of a set of springs that acts against the lower side of the traverse block 3C and is laying within the U-formed beam 15, and which ensures that rotation of the drive shaft 7 does not rotate the pipe handler assembly 3. If the pipe handler assembly 3 is to be rotated in the light load regime, this is performed by the auxiliary motor.

In the load regime above 15 tons, the springs that keep the pipe handler device 3B clear from the load shoulder 7S collapse, and the entire pipe handler assembly 3 is now able to rotate by rotating the drive shaft 7. The prior art technology makes use of that the pipe handler assembly is resting on a threaded shoulder, which due to the magnitude of the forces and the affinity to fatigue fracture of the threaded connection, need to have a very fine pitch. The traditional threaded load shoulder is very time consuming to disassemble, both due to access and because the fine pitch of the threads, it requires a large number of rotations to unscrew the shoulder from the shaft.

One new feature of the drilling machine 10 is the load shoulder 7S which have as basis the surface that is shown as 40 in FIGS. 16A-16B, where two crescent shaped inserts 41 that together constitute a circular part, rest on this surface and transmit the forces from the pipe handler device 3B to the main shaft 7. These two crescent shaped inserts 41 are during normal operation enclosed by the traverse block 3C and kept in place by a locking device which can be quick released. In an incident where the main shaft 7 is to be pulled, or the pipe handling device 3B is to be replaced, the locking means is released, the pipe handling device 3B is lifted, the crescent shaped inserts 41 removed, and the pipe handling device is then free relative to the main shaft 7.

Figure 10:
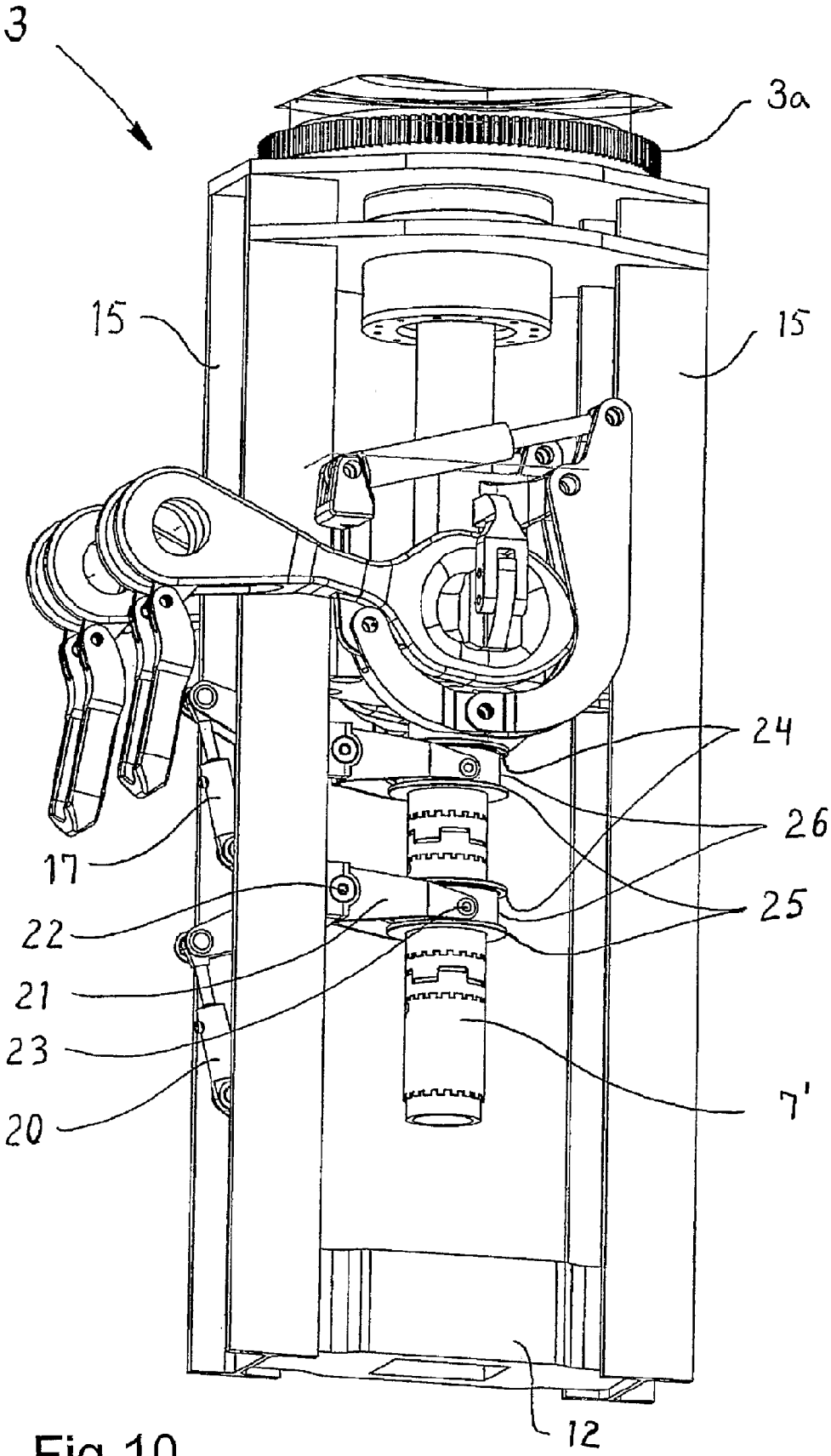
FIG. 10 shows the pipe handler apparatus in closer detail.
Figure 11:
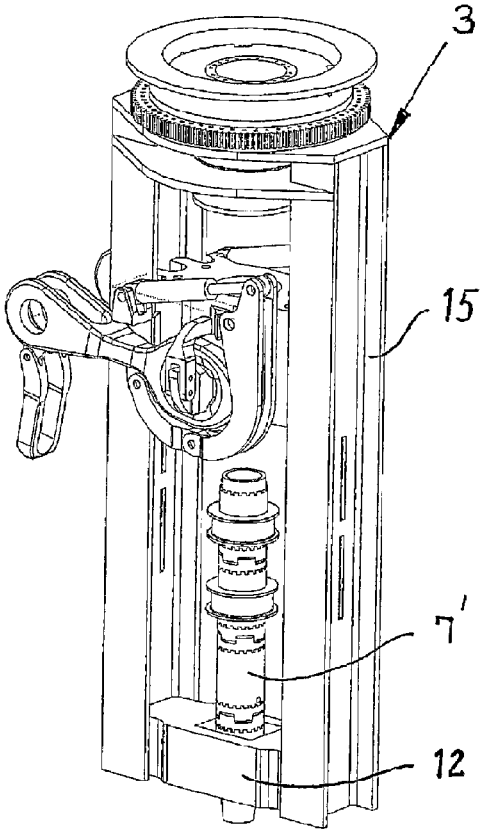
FIG. 11 shows the pipe handler apparatus with a shaft stub attached.
Figure 12:
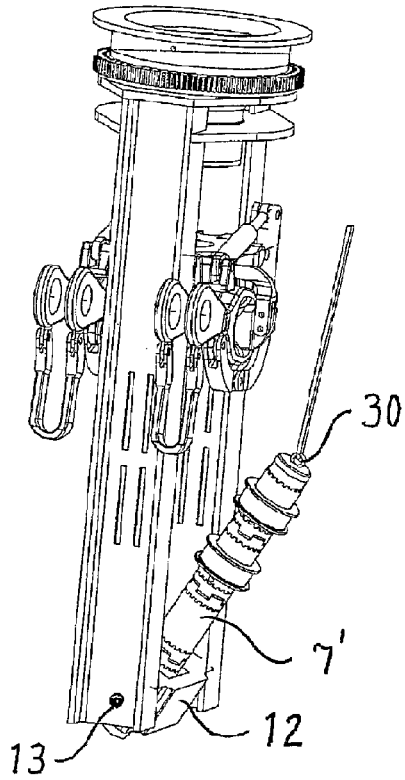
FIG. 12 shows the pipe handler apparatus with the shaft stub pivoted and ready for elevation.
Figure 13:
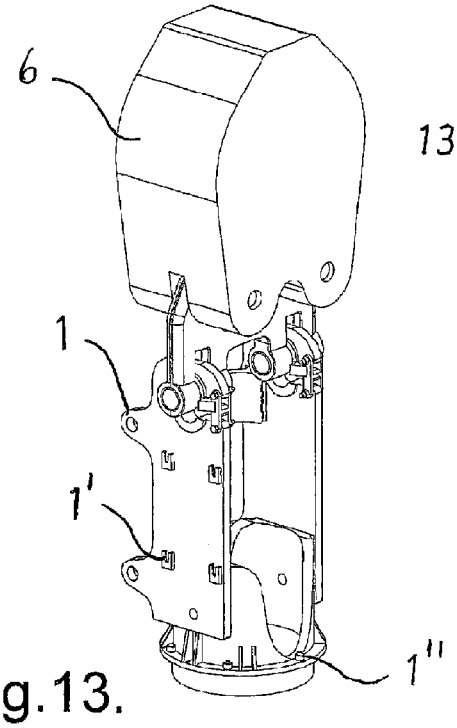
FIG. 13 shows the load frame including further details.

FIG. 10 shows the complete pipe handling assembly 3, which also shows the attachment for a torque arrestor or clamping device 12 in the form of two very heavy beams 15. These beams 15 are heavy for two reasons, in part because they require great stiffness due to the torque that the wrench 12 is subjected to, in part because the beams 15 need to be heavy enough to take the entire weight of the drilling machine 10. This, because an important part of the new technology is to be able to use the drawworks of the drilling vessel to perform heavy maintenance operations on the rig. The torque wrench 12, as shown in FIG. 5, includes two hydraulic cylinders 13*a* and clamping dies 13*b* that can act directly against a pipe part in order to keep it rotary stiff.

As shown in FIG. 8, a circular seal is arranged between the rotary drive shaft 7 and the static transmission 4. The circular seal will over time be worn down because of the friction that arises between a static and rotating part. FIG. 8 shows a section through the transmission 4 and the seal in particular at the interface between the transmission 4 and the drive shaft 7.

The prior solutions are based on that a replaceable wear ring is fixed to the main shaft to prevent that the main shaft itself is worn down. Prior art technology also includes pressure lubricating channels to lubricate the sealing connection.

The task to replace the seal has traditionally been very time consuming, since it includes the following work operations: unscrew the load shoulder; remove the pipe handler assembly; drain the lubrication oil from the transmission; take out the old seal; install a new one.

By the new structure a shoulder S on the drive shaft 7 is introduced. This shoulder S is screwed onto the drive shaft 7 so that the shaft can be removed during replacement of the wear ring. In this shoulder threaded bolts (not shown) with locking means of the type counter nut are screwed into the shoulder. When these bolts are turned, four in the preferred embodiment, the wear ring is elevated so that fresh sealing sets are engaged in the sealing process. By introducing this technology, it will not be required to replace seals within the total operational lifetime of the machine.

The drive shaft 7 is as mentioned hollow to allow pumping of drilling mud down into the well. At the lower extension of the drive shaft 7, a shaft stub 7' is attached that receives a shaft valve 11, which has the purpose of isolating the well pressure in an emergency situation, as well as shut off for the drilling mud in a normal drilling situation. See FIG. 14. The connection between the drive shaft 7 and the shaft stub 7' is a threaded connection which is made up by tongs or the pipe handler assembly 3 of the drilling machine 10. Together the drive shaft 7 and the shaft stub 7' is called a main shaft 7, 7'. This unit is very maintenance intensive, so in order to increase the maintenance intervals, two redundant valves are integrated in the system, each having respective activating or operating mechanism 18, 19. In addition to the automatic activated valves, the regulations require that a manually operated valve is present. In order to effectively be able to handle these three valves, which may have a weight of 3-600 kg, the following is included in an improved concept.

In FIG. 10 is shown a typical mechanism for maneuvering such a redundant valve in its normal operational form. By actuation of a hydraulic cylinder 20, an arm 21 is pivoted about a pivotal suspension point 22 such that two rollers 23 can act against respective radially directed end walls 24 in a centre groove 26 within an annular structure 25 SO that the structure 25 can be manipulated up and down. The annular structure 25 is in mechanical connection with said internal valve 11 within the shaft stub 7', i.e. normally a ball valve, which opens and closes for the drilling mud flow through the main shaft 7,7'. A corresponding working cylinder 17 can operate a second valve by completely similar mechanism.

A new feature by the mechanism is, in addition, that it has a radially acting pivotal centre that by release of the mechanical quick release connection means allows that the arms that retain the activating rollers can pivot outwardly to a parked position. In its pivoted position the arms are free from the groove in the annular structure 25, and the contact points of the interface against the main shaft 7, 7' and the valves are removed. Each activating mechanism can easily be disassembled and removed from the central line of the shaft.

Figure 14:
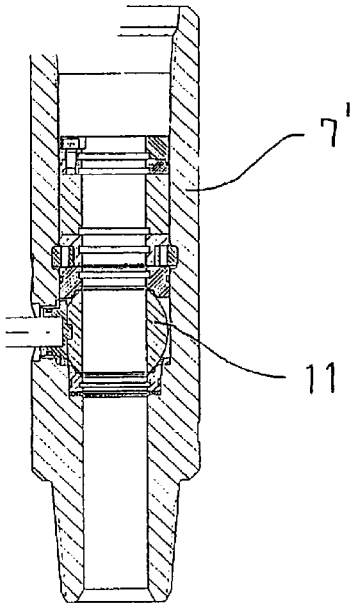
FIG. 14 shows a typical safety valve arranged within a pipe spool.

Relative to the prior art, such as FIG. 14 illustrates, the shaft valves 11 are like a traditional ball valve having floating seat and mechanical torque actuation. The shaft valve 11 has a threaded male and female portion that connects the shaft valve 11 to the shaft 7' on the female or male side, and next shaft valve 11 at opposite side. Up to three valves are joined to the shaft 7' in this way, and the last valve on the string terminates against a wear piece before the drill string itself is joined in. The shaft valve 11 is fail safe as well as operation safe, and due to the abrasive nature of the drilling mud the wear on the valves 11 is substantial so that frequent replacement is required.

Relative to what that has been usual until today, the new drilling machine 10 is equipped with three valves 11, two redundant and one manual. Due to unit costs per valve 11, considered relative to the time it takes to replace one valve, the new drilling machine 10 is so arranged that all the valves 11 are replaced as a unit when the life time to one redundant valve 11 expires. Since three assembled valves weight 300-900 kg, it is important that the drilling machine 10 is arranged for quick replacement, and for this purpose a new device is arranged on the pipe handler assembly which is distinguished from the prior art.

A replacement sequence is initiated in that clamping takes place around the shaft stub 7' and the valve set with a pipe clamping device 12, shown in FIG. 5, and then use the main motors 5 on the drilling machine 10 to set such a torque in the drive shaft 7 that the threaded connection between the drive shaft 7 and the shaft stub 7' is released. Then the entire shaft stub 7' and valve set is lowered by using a hydraulic hoisting means in such a way that the two redundant automatic operated valves 11 as well as the manual emergency valve is lowered. See FIG. 11. From the vertical position, that the pipe clamping device 12 initially has, the pipe clamping device 12 can be tilted about a pivotal point 13, see FIG. 12, so that the shaft stub 7' including the valves 11 can be handled by means of a winch and lifting nipple 30. Both parts are equipment that normally is available on a drilling deck.

Figure 17:
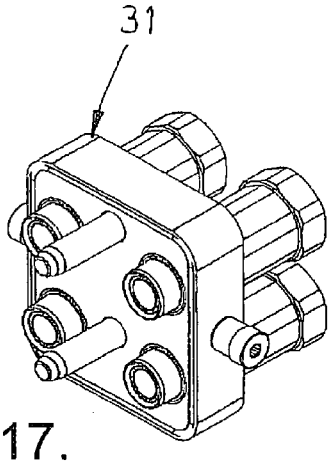
FIG. 17 shows a hydraulic/electric connection module.

All actuators and instruments are in a usual way collected in a common cabinet 16. In order to take care of the friendliness that the new modularisation and service provide for this concept, two measures are introduced:

1) The cabinet 16 is considered as a module that can be replaced in a minimum of time. Thus it is introduced a common connecting module 31 for each and all connections so that all hydraulic connecting points can be decoupled without use of thread based couplings as done today. One embodiment for this is shown in FIG. 17, where it is exemplified how four connections can be decoupled by a manipulation, without use of any tool, and without risk for leakages. The example shown in FIG. 17 is scaleable to include the up to 48 connections that exist between a valve and a hydraulic cabinet. The time saving during a replacement operation is by this substantial.
2) For instruments analogue strategy is chosen, with quick connecting solution to reduce the time for replacement of the cabinet.

As known, the transmission has as task to reduce the rotary speed of the electro motor(s) down to the working range for drilling operations, typically 8,2:1. Prior drilling machines also use reduction power transmissions, having either one or two motors for drive. By the new concept, the efficiency requirement is set at 160% relative to most drilling operations today. This entails that, by malfunction of a motor, one can still continue operation by 80% effect. This means that the operation can be continued with only minor reduction in efficiency. Since a usual fault modus by an electro motor is breakdown, by which is meant that the motor is not able to rotate, it is decisive to have a method for quick disconnection of a motor. By quick is meant less than 15 minutes, which is normally the time available before the drill string gets stuck.

Figure 9A:
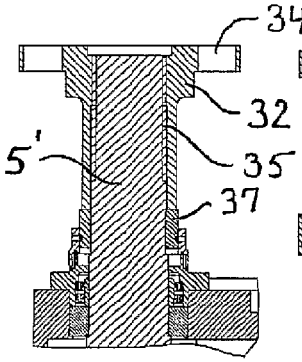
FIG. 9A-9C show a sequence for disconnection between the drive motor shaft and the transmission.
Figure 9B:
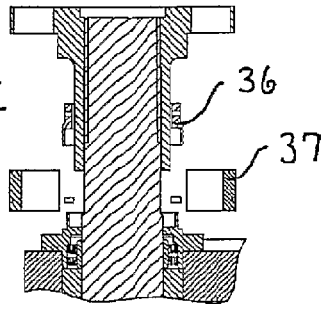
Figure 9C:
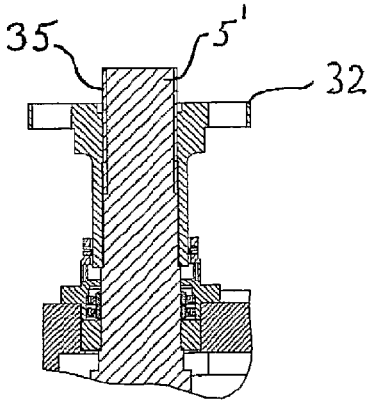

FIG. 8 show an axial section through the transmission 4 in one embodiment. Motor pinions 5' form connection between the exits of the motors 5 and the entrance of the transmission 4. To be able to use the inherent advantage in having one motor 5 in over capacity, it is necessary with a device that quickly allows a motor 5 to be disconnected. An example of such an embodiment is shown in FIG. 9A-9C. The figures show one of the power transmission entrances. The female part 32 of a finger connection is normally provided on the transmission 4 and the male part 33 is normally provided on the motor 5. The male part 33 has a rim of pegs (fingers, not shown) arranged on its circumference which are to cooperate with holes 34 cut out in the female part 32. The coupling is "loose" in the sense that it will be able to pick up small angular deviations between the shafts. The connection between this female part 32 of the coupling and the shaft 5' itself takes place by means of so-called "DIN splines" 35 on the upper part of the shaft 5'.

By elevating a locking ring 36, two crescent shaped spacer elements 37 can be removed so that the female part 32 of the finger coupling can be pulled down and the fingers on the male part 33 can thus be released from their respective holes 34. See sequence in FIGS. 9A-9C. The height of the spacer ring 37 corresponds with the length of the area with splines (this means splines in the longitudinal direction of the shaft). This implies that the female part 32 is immobile while the shaft 5' rotates with the transmission, e.g. when drive takes place by one motor 5 only. This operation can be performed without tool, and thus take shorter time than the critical time frame.

The interface between the load frame 1 and the dolly 9 is per se analogue with known technology. By this it is meant that there exists a traditional bolted connection between the load frame and the dolly.

The drilling machine 10 is, as mentioned, elevated up and down by the drawworks of the vessel. The power supply, alternating power for operation of the main motors and the auxiliary motors, as well as hydraulic power in the form of a pressure and return circuit, coolant to the motors and lubricant coolers and control signal cables, normally takes place through long connecting hoses that are 40-70 meters long and associated connecting manifolds.

These hoses have, due to their mobile nature, a strong affinity to get caught in surrounding structures and by that are torn off when the hoisting system moves. All operations by use of the drilling machine cease if one or more hoses are torn off, and repair is required before the operation can commence. To reduce the repair time it is essential to reduce the number of working operations. If an instrument hose is torn off, which normally contains up to 56 conductors, all need to be terminated.

The new concept has taken in use a converting unit which is mounted on the machine, and takes the normal 56 signals and convert those who are possible to convert to digital signals. These digital signals can be transferred by means of one single cable from the drilling machine 10 through the hose to the drilling vessel itself. By taking in use such a technique, the number of conductors within the cable is reduced from 56 to 26. The reduction in repair time is analogue, since each cable has relatively similar time consumption for making up connection.

The electric motors 5, which constitute the main drive of the machine, have a power efficiency of 92-98% depending on rotational speed and torque. This results in that 2-8% of the installed effect in the electro motors need to be cooled off in order to keep a stable operating temperature. In accordance with known art this is in entirety accomplished by use of forced air cooling. Forced air cooling results in that there is a fan present driven by an assisting motor which is mounted to the main motor. This fan draws air via a filter housing through a 200 mm flexible hose into the motor. A replacement of the main motor results in the following steps:

1. Disassemble fan housing and hose.
2. Disassemble filter housing.
3. Disassemble rotary meter.
4. Disassemble motor brake.

This is a time consuming operation.

The basis for the new concept is a reduction in the number of working operations for the replacement of modules on the assembly. Now the cooling system is changed in that it is integrated into the main motor, as forced water cooling. The pump of the forced water cooling is not located on the machine, but contrary within a centrally located machine room, since all drilling vessels have distributed water based cooling systems. This results in that the outer appearance of the main motor itself does not have any changes, but a spirally formed cooling circuit, having inlet at the upper end of the motor and exit at the lower end or vice versa, is integrated into the encapsulation of the motor. This results in that the operation of having the motor replaced as a module has the following steps:

Disassemble rotary meter; loosen water connections; disassemble the motor brake. The time saving is analogue with the reduction of working operations, i.e. ca. 50%.

The motor is, according to known technology, fixed to the power transmission, normally vertical mounted and bolted to the transmission. By replacement of the motor it is very important that the motor is mounted in parallel with the transmission shaft, since an angle between the motor shaft and the transmission shaft results in that the coupling point is rapidly worn out. Today it is normal that a laser based measuring system is used when an electric motor is replaced, and ad that measure between the base of the machine and the transmission which is necessary to bring the alignment of the shafts as perfect as possible. This procedure is time consuming under repair and replacement of motor.

With the new modularized drilling machine 10, the motor 5 is mounted on a heavy machined plate, where the main shaft of the electro motor 5 is precisely aligned parallel to the machined surface. The load frame 1 has in turn machined wedge grooves 1', see FIG. 13, which correspond with the machined plate of the electro motor 5. During assembly of a new electro motor 5 having attached plate, this is lowered down into the wedge grooves 1' such that the orientation is getting correct. The motor 5 with the surface is fixed by two bolts. The hydraulic activated bolt and nut arrangement is also indicated by the reference number 1".

The interface between the load frame 1 and the pulley block adapter 2 is optimized for rapid disconnection from each other, since the pulley block adapter 2 has ready lifting lugs ready for use to be able to pull out the main shaft 7, 7'. This interface is prepared as the figures show. The load frame 1 terminates in an upper part having an inverted hook, which is closed by a simple lock that can easily be opened and closed. In this way the pulley block adapter 2 can be released from the load frame 1 without need for any heavier tools.

The dolly 9 is as mentioned moving on a set of rails that guides the movement up and down. The dimension and the distance between these two rails are varying from vessel to vessel. In order to comply with different vessels with the same structure, the following dolly is developed:

The dolly 9 is designed as an octagon with a set of guiding wheels at each short ends. The guiding wheels or rollers can be released and moved laterally by skidding them in a guide track on the 45° part of the octagon that constitutes the main body of the dolly.

Figure 15:
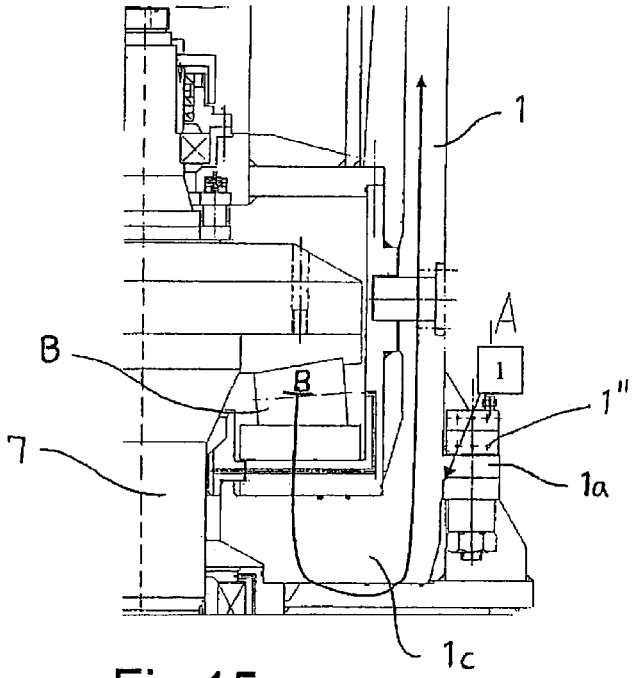
FIG. 15 illustrates the load path in the new drilling machine.

As it appears from FIG. 15, the connection between the main shaft 7 and swivel do not need to transfer any forces of significance, since these forces follow the arrow from the main shaft via the main bearing B to the bottom plate 1*c* within the load frame 1 and further up. It is thus possible to make the connection in the form of bolts with said quick actuation, and being performed by mechanical or hydraulic release principles. The preferred method is hydraulic, as indicated, and as illustrated in the figure by reference number 1".

Between the swivel and the upper part of the main shaft is a rotary seal located. The rotary seal has as purpose to connect the static part of the drilling mud system with the rotating main shaft. The rotary seal has a limited life time. During the entire life time of a drilling machine, it is needed to calculate a great number of leakages of mud from this unit. According to the prior art, the upper shaft seals are exposed for the drilling mud by failure in the rotary seal. A rotary disc has proven to be insufficient for protecting the underneath located seal against drilling mud, since there is no guarantee for when a rotation of the main shaft occurs, which is a requirement for good protection. The consequence of this is that the seals become worn out and need to be replaced, or in uttermost consequence, the drilling mud migrates into the main roller bearing, with breakdown of the entire drilling machine as result.

FIG. 18-23 show a drilling machine 10' which is a revised edition of the drilling machine 10 shown in the FIGS. 1-17. The pipe handler assembly 3' is this time not drawn together with the drilling machine, but is shown in detail in the FIGS. 24-28. The pipe handler assembly 3' is, however, in use attached in substantially the same way as the first embodiment.

The drilling machine 10' consists basically of the same main components as the drilling machine 10. Those components that correspond to each other have the same reference number with the addition of a mark'. The drilling machine 10' is still modularly constructed and is shown in the drawings with the parts separated from each other. The drilling machine 10' is designed to be hung in a pulley block 6' in a drawworks arranged in a derrick (not shown) on board a vessel performing offshore drilling activity. The drilling machine 10' is guided by a dolly 9' running along rails attached to the derrick. The drilling machine 10' turns drill pipes around a drilling axis to drill an oil and gas well in the sea bed. With reference to FIGS. 18-22 the drilling machine 10' will firstly be described in broad outline, i.e. the construction of the main components thereof. A more detailed description of further components and internal parts will follow with reference to the FIGS. 23-28. Relative positioning terms as "upper", "lower", "vertical", "horizontal" and "drilling axis" are related to a drilling machine in activity. It is again to be understood that the drilling machine 10' consists of many functional details which will not be described in detail here.

In order to that the description shall not be too detailed and complex, it is confined to the main components and the interactions thereof.

Figure 18:
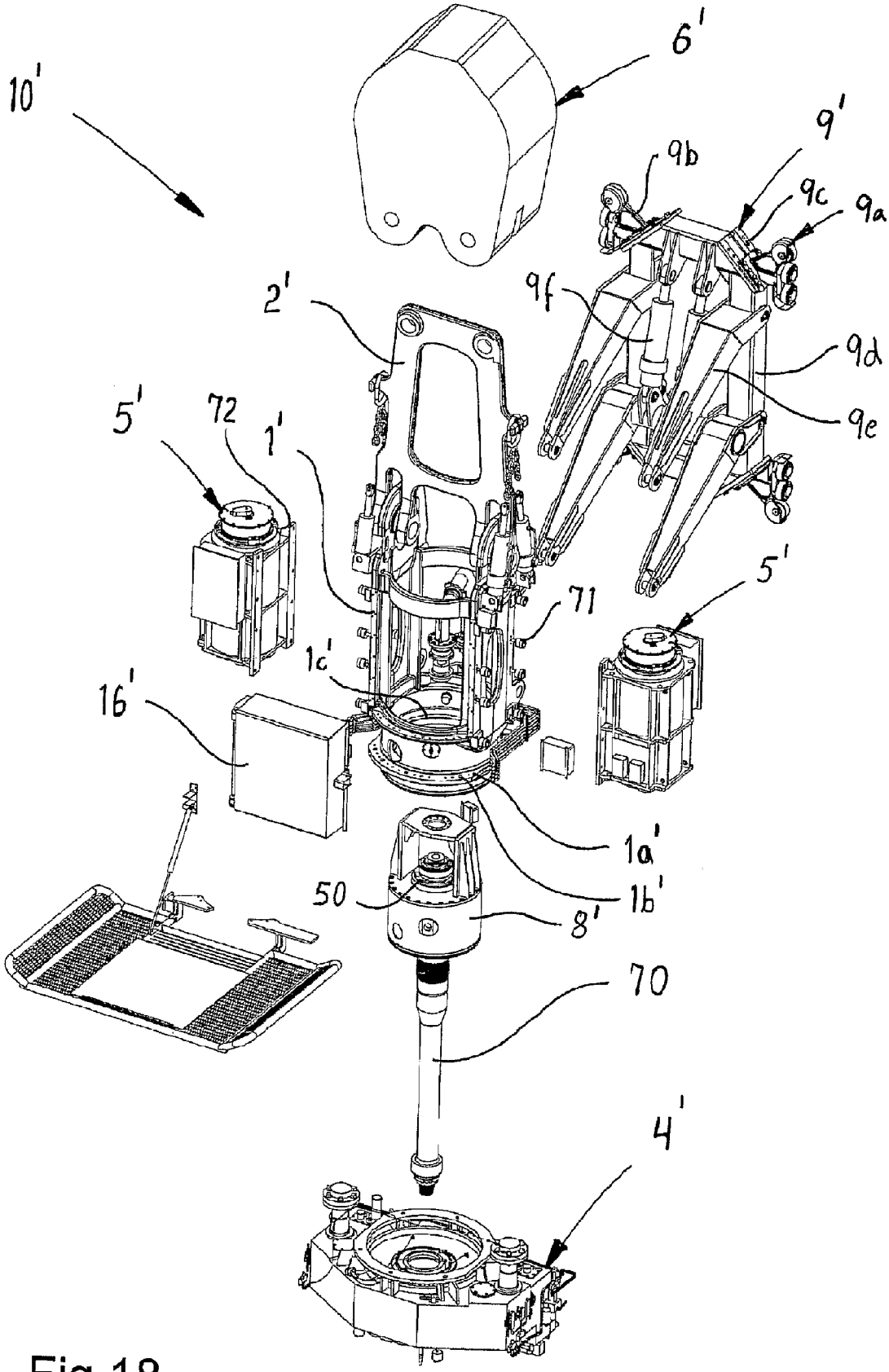
FIG. 18 shows an exploded, perspective view of a second embodiment of the drilling machine according to the invention.
Figure 19:
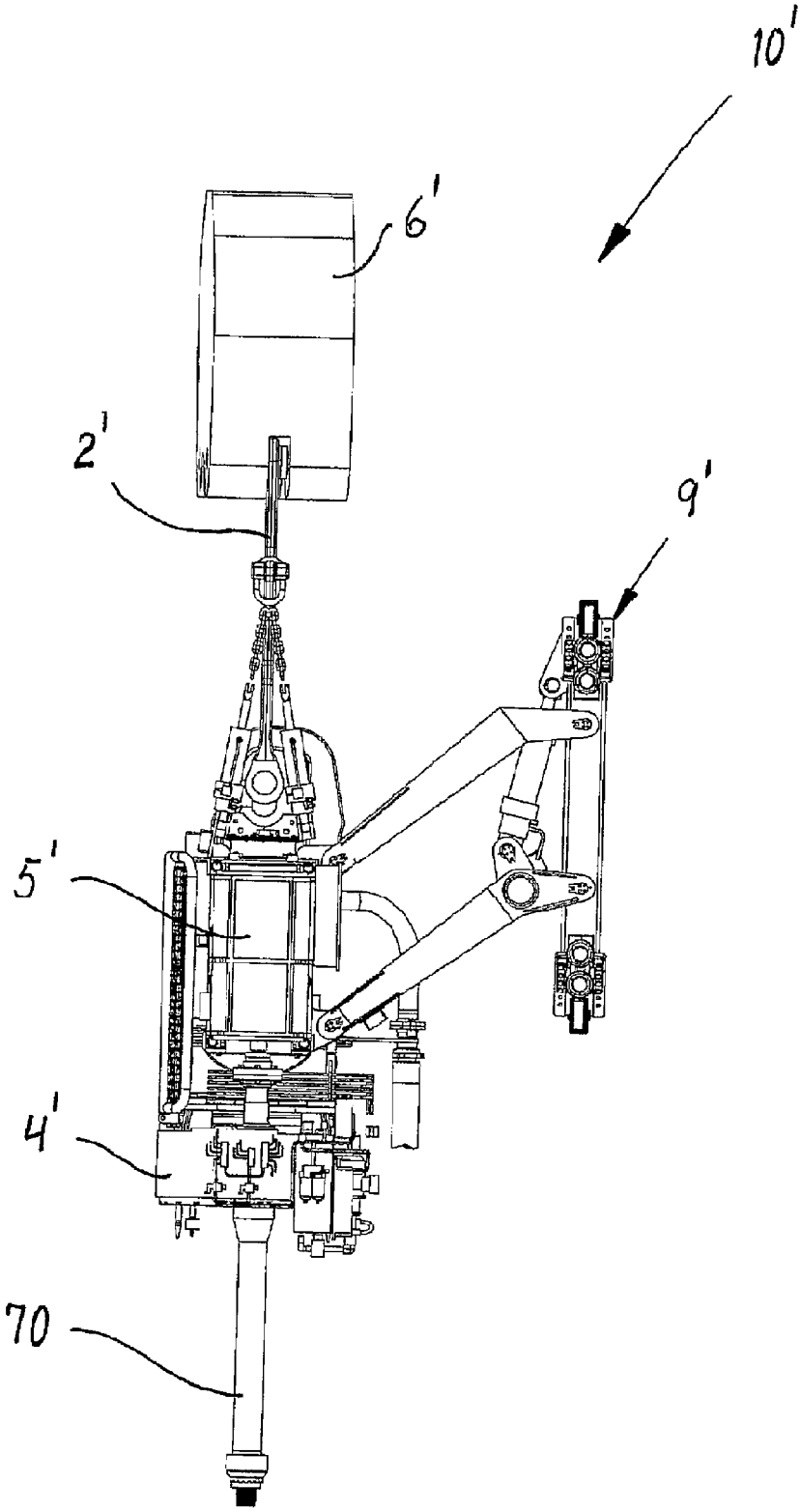
FIG. 19 shows a side view of the drilling machine depicted in FIG. 18.
Figure 20:
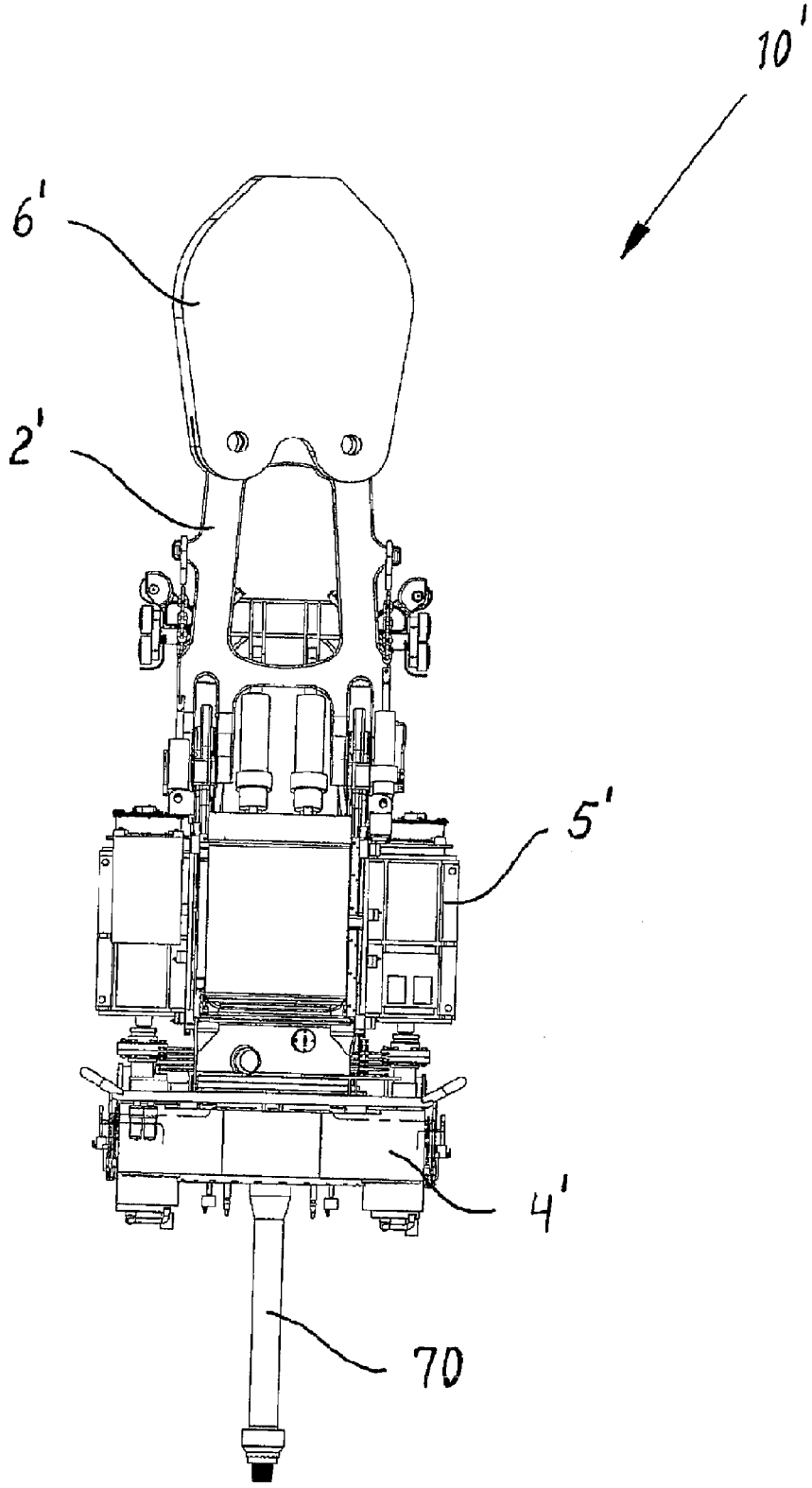
FIG. 20 shows a front view of the drilling machine depicted in FIG. 18.
Figure 21:
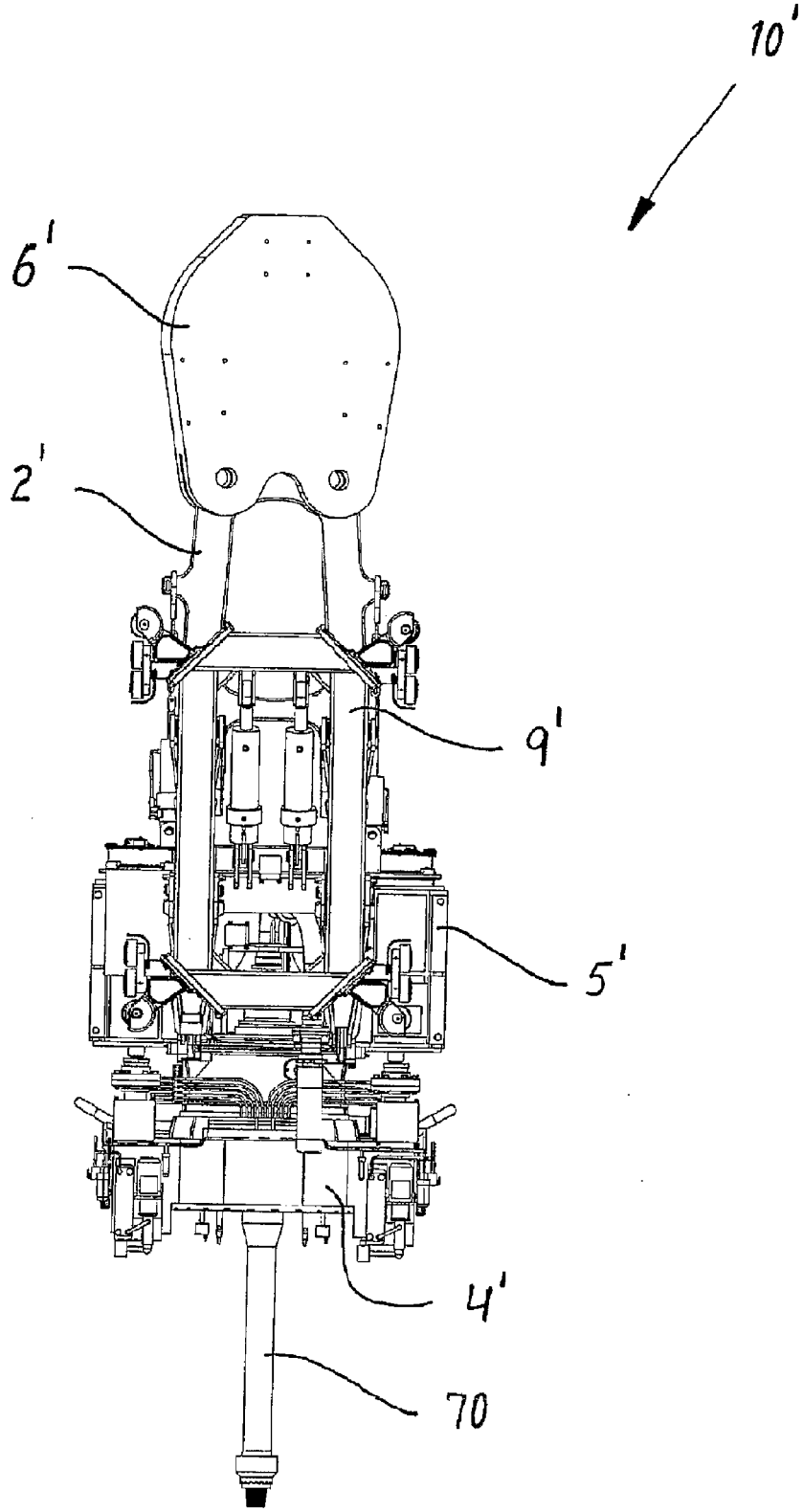
FIG. 21 shows a rear view of the drilling machine depicted in FIG. 18.

With reference to FIG. 18, an adapter 2' for adaptation to different types of vessels is located uppermost and adjacent to the pulley (travelling) block 6'. The adapter 2' is releasable attached to the pulley block 6' at the same time as it also is releasable connected to a below located load frame 1'. The load frame 1' has among other factors the task to relieve axial loads in the drive shaft of the drilling machine 10'. The load frame 1' is also a central element regarding the modular construction of the drilling machine 10'. The other component modules are built up around the load frame 1'. The load frame module 1' is suitably made and constructed as a maintenance free structural element, preferably without any moving parts. It may for example be molded of iron in one piece or of any other suitable structural material, but, as mentioned, omit maintenance.

A valve and instrument cabinet 16' is attached to the load frame 1' and is pivotal attached in order to easier get access to a rotary seal behind the cabinet.

At its lower end the load frame module 1' is connected to a power transmission module 4'. The way the power transmission module 4' is attached to the load frame module 1' is particular in that quick coupling means preferably are used, such as hydraulic bolts and nuts. The bolts can, for example, be fixedly attached to the power transmission housing and project upwardly. The lower part of the load frame 1' has a flange 1*a*' with bolt holes 1*b*' that correspond with said bolts. During assembly, the load frame 1' is oriented and is threaded down over the hydraulic, upwards projecting bolts before final assembly by nuts that are threaded by "finger force" onto said bolts till abutment against the load frame flange 1*a*' before the bolts are relieved for their hydraulic pressure. However, it is still not any presumption that the means are quick coupling, even if it is preferred with respect to necessary use of time during disassembly/assembly. Also traditional bolts and nuts can be used, possibly other suitable fixing means.

With reference to FIG. 18-22, two main driving motors 5' are arranged on the power transmission module 4' in the illustrated embodiment. Preferably, the driving motors 5' are diametrically located relative to the drilling axis of the drilling machine 10'. By such location they counterbalance each other with regard to forces and torques when both motors 5' are in activity. However, it is still to be noted that the driving motors 5' are so dimensioned that drilling activity can be performed with only one of the driving motors 5' in action. Each driving motor 5' is easily and quick releasable from the power transmission module 4' and the load frame module 1'.

Each driving motor 5' is non-rotatable fixed to respective sides of the vertical parts of the load frame 1'. The way in which the driving motors 5' are attached, has quick mounting/dismounting operation as a major criterion. The load frame 1' has several quick coupling means 71 arranged to its vertical parts. The driving motors 5' have vertically arranged rail profiles 72 having apertures for cooperation with said quick coupling means 71. The profile can take the form of an angle.

Each driving motor 5' has, like in the first embodiment, a pinion gear in the lower end thereof, which via an idler gear is in mesh with a gear rim of substantial diameter. The gear rim has a central hole having splines designed to cooperate with axially extending splines in the drive shaft 70 for rotational power transmission. The transmission structure provides a reduction power transmission.

Figure 22:
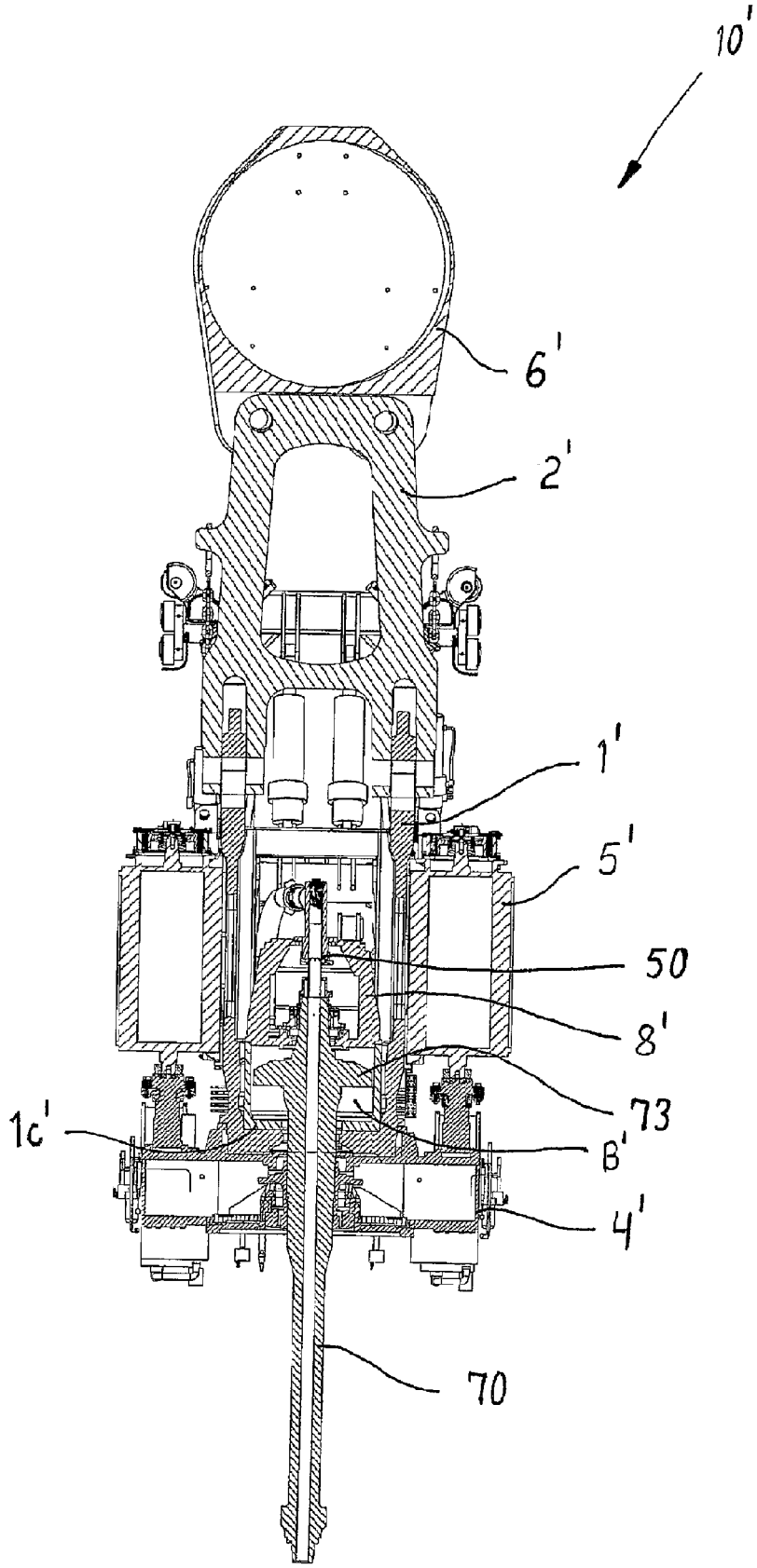
FIG. 22 shows a longitudinal section through the drilling machine shown in FIG. 18.
Figure 23:
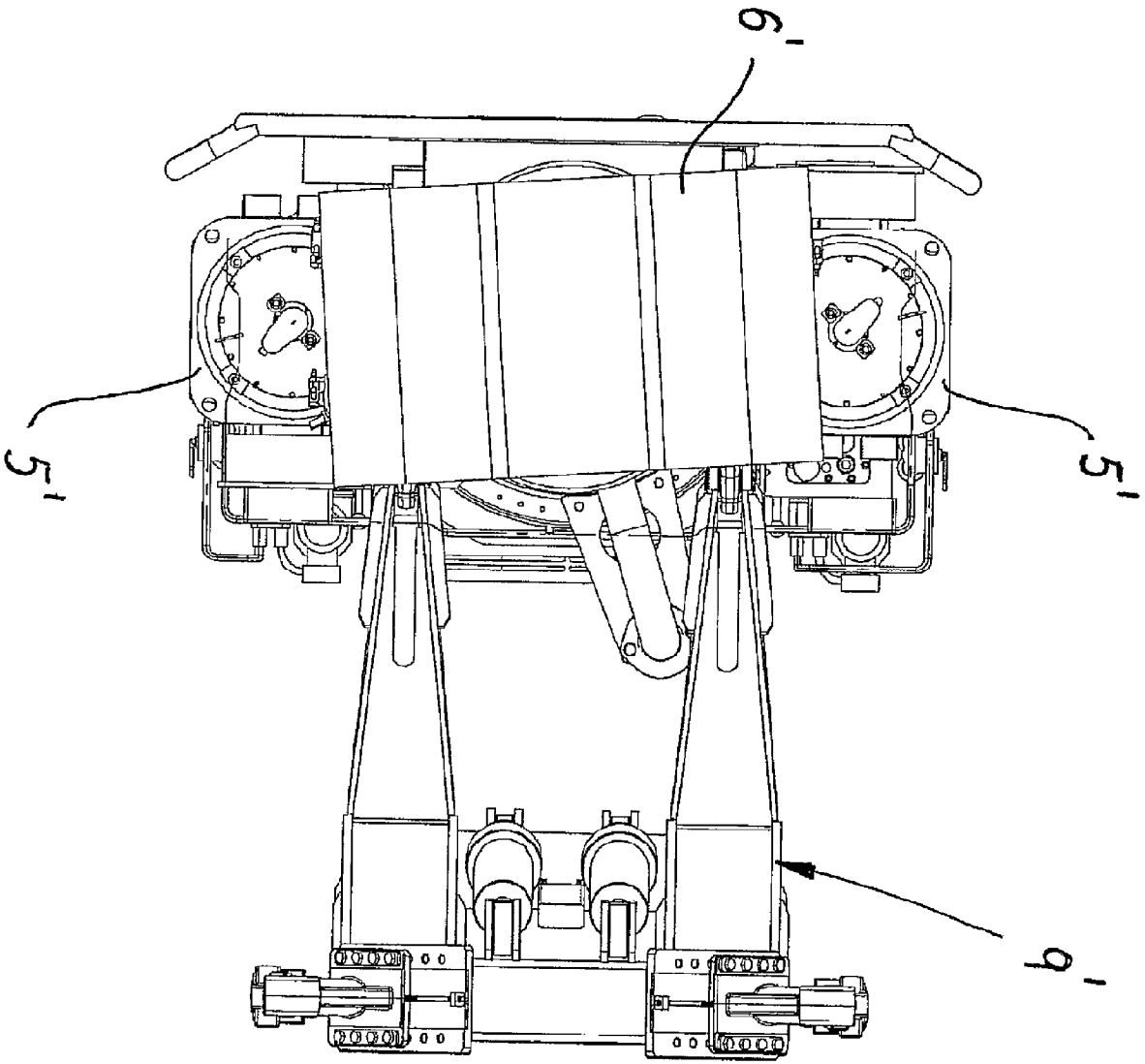
FIG. 23 shows a top view of the drilling machine depicted in FIG. 18.

As it appears from FIG. 22, the drive shaft 70 is in connection with an above located swivel 50. The swivel 50 is a device for enabling transfer of liquid, in this case mud, from a stationary part to a rotating part like the drive shaft 7 in this case. The swivel 50 has an enclosing housing 8' and various seals like the first embodiment. The lower end of the swivel housing 8' is abutting against a bottom plate 1*c*' in the load frame 1' and is further non-rotatable attached to the load frame 1' as illustrated in the figure and having apertures cut out in the swivel housing 8' and the side wall of the load frame 1'. They can, however, in a quickly and easy way be released from each other during a maintenance operation. Actually, they are standing stable relative to each other without such fixing means. The upper end of the drive shaft 70 is placed within the swivel housing 8'. A main bearing (not drawn, but is supposed to be located where it is indicated with B') is located between a ring flange 73 on the drive shaft 70 and said bottom plate 1*c*' in the load frame 1'. This is shown in detail in FIG. 22. The main load path is again, distinct from the prior art, totally independent of the reduction power transmission 4'. The load picture that the reduction power transmission 4' is subjected to is now only conditional on the dead weight of the transmission 4' and a below attached pipe handler unit 3', which is shown and described separately in context with the FIGS. 24-28. The pipe handler unit 3' is depending in the same way as the first embodiment, for example as shown in FIGS. 2-5. These results in that less comprehensive mechanical attachment means can be used compared with previous solutions.

Also for this embodiment it is desired to maintain the idea about the "modular" and the "quick releasable" as a red line through the entire new concept. Preferably, fastening means having a quicker operation possibility than bolts having a threaded end and corresponding nut, are used. Preferred solution is, as already mentioned, based on hydraulic operation, as previously described.

The drive shaft 70 is clearly shown in FIG. 22 and is similar to the first embodiment and will not be described again.

Reference is now made to FIGS. 24-28 for description of the pipe handler assembly 3'. As before, the pipe handler assembly 3' is attached to the lower side of the transmission 4', suitably by means of quick release means as previously described. For example, the bolts can be fixedly connected to the transmission housing and projecting downwards. The upper part of the pipe handler assembly 3' has a flange 80 with bolt holes 81 that correspond with said bolts. During assembly the pipe handler assembly 3' is oriented and is treaded up over the hydraulic, downwards projecting bolts before final fixation with nuts that are screwed with "finger force" onto said bolts until abutment against the flange 80 on the pipe handler assembly 3' before the bolts are relieved from their hydraulic pressure. The bolts can also be in the form of pin bolts. It is nevertheless any presumption that the means are quick releasable, even if it is preferred with regard to necessary use of time during disassembly/assembly. Also traditional bolts and nuts can be used, possibly other suitable fastening means.

Figure 25:
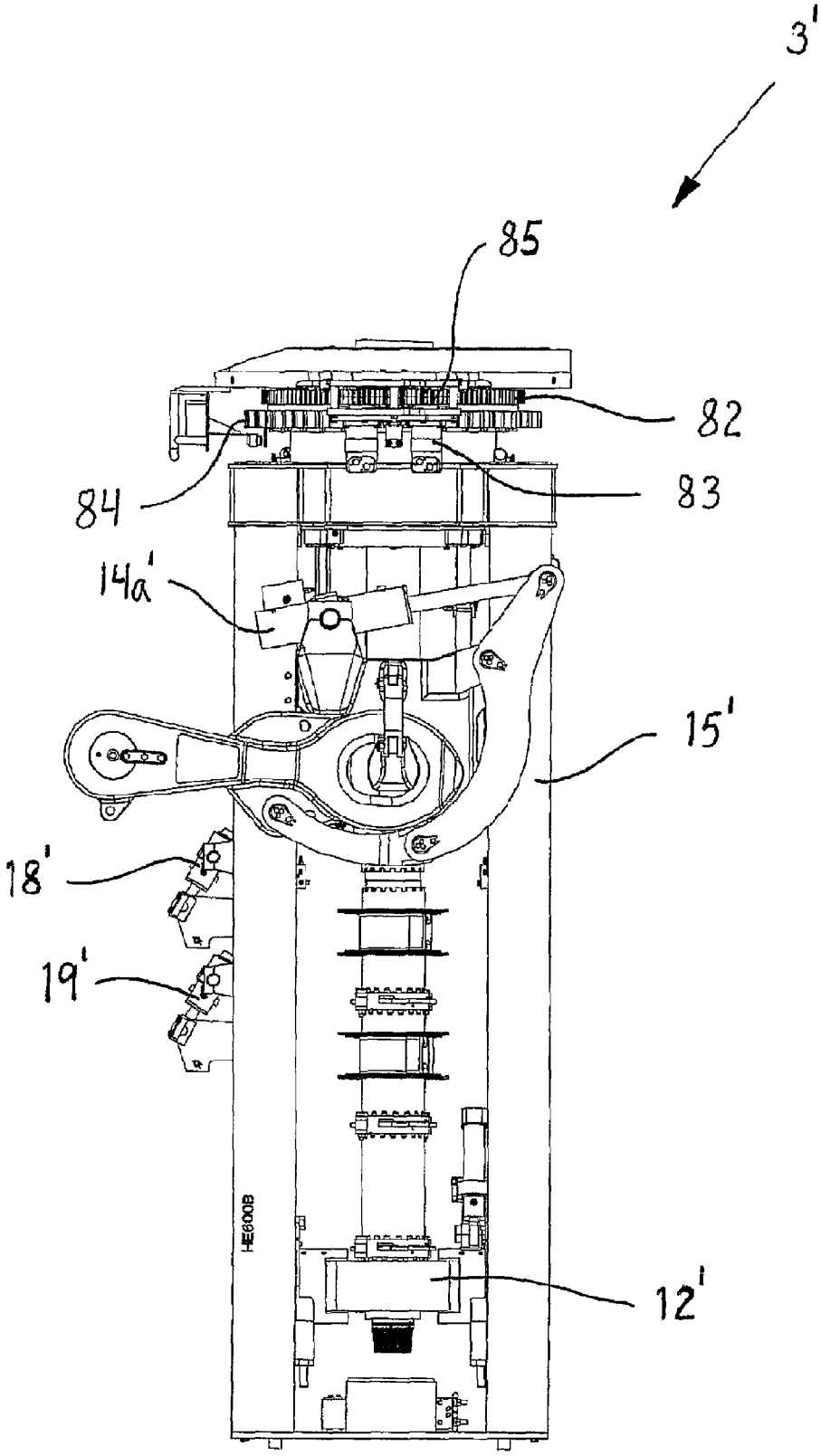
FIG. 25 shows a side view of the pipe handler apparatus.

On top of the pipe handler assembly 3' a gear rim 82 that can be operated by one or two auxiliary motors 83 via respective pinion gears 85 is arranged, see in particular FIG. 25. Each auxiliary motor 83 is able to turn the pipe handler assembly 360° around and is able to lock the assembly in any rotary position. For this purpose it has a bigger gear rim 84 that is operated by one or more locking pawls that can be activated to engagement with one or more teeth on the gear rim 84.

Figure 24:
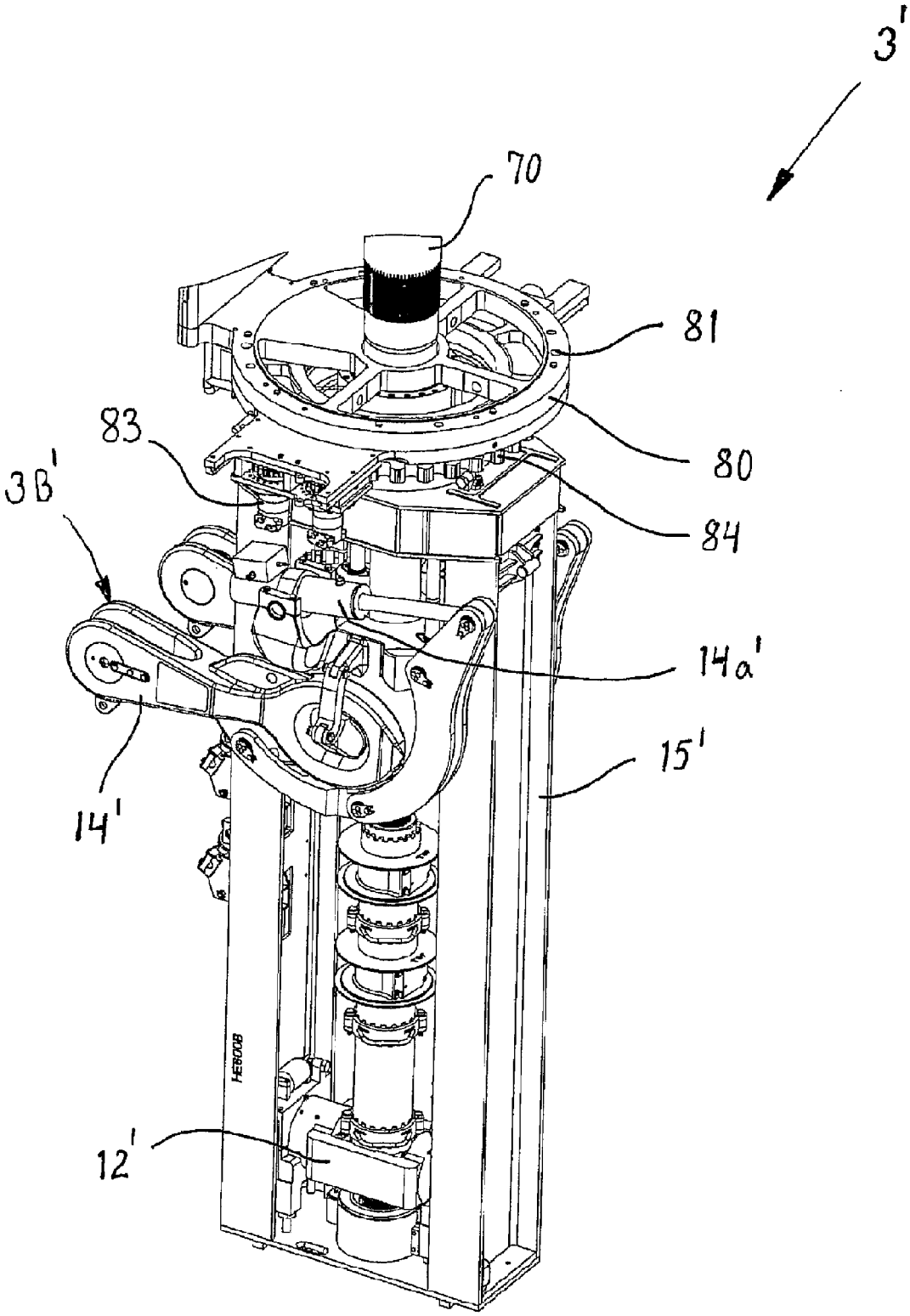
FIG. 24 shows a perspective view of the pipe handler apparatus.

The pipe handler device 3B' itself has a pair of in parallel extending links 14', see for example FIG. 24, that can be maneuvered by respective working cylinders 14*a*'. At the end of the links 14' shackles or similar are provided, which in turn carry depending arms (not shown) which together carry an elevator (not shown) in the lower ends thereof, in the same way as the traditional one. The elevator is adapted to be able to enclose a pipe end to be able to carry a tubular element. The elevator can, by means of the working cylinders 14*a*', be manipulated in and out of the drill centre. During a regular drilling operation the elevator is put aside of the drill centre. The complete unit is normally called an elevator mechanism.

The pipe handler assembly 3' has, as before, the object to form a secondary, non-rotatable load path, which enables the drilling machine 10' to be used as a more conventional lifting equipment, as previously described.

For the further detailed description of the pipe handler unit 3', which functions substantially in the same way as the first embodiment, reference is made to the earlier description of FIGS. 7-17. Parts and components in this embodiment that are the same as in the first embodiment have been given the same reference numbers with the addition of a mark'.

Figure 26:
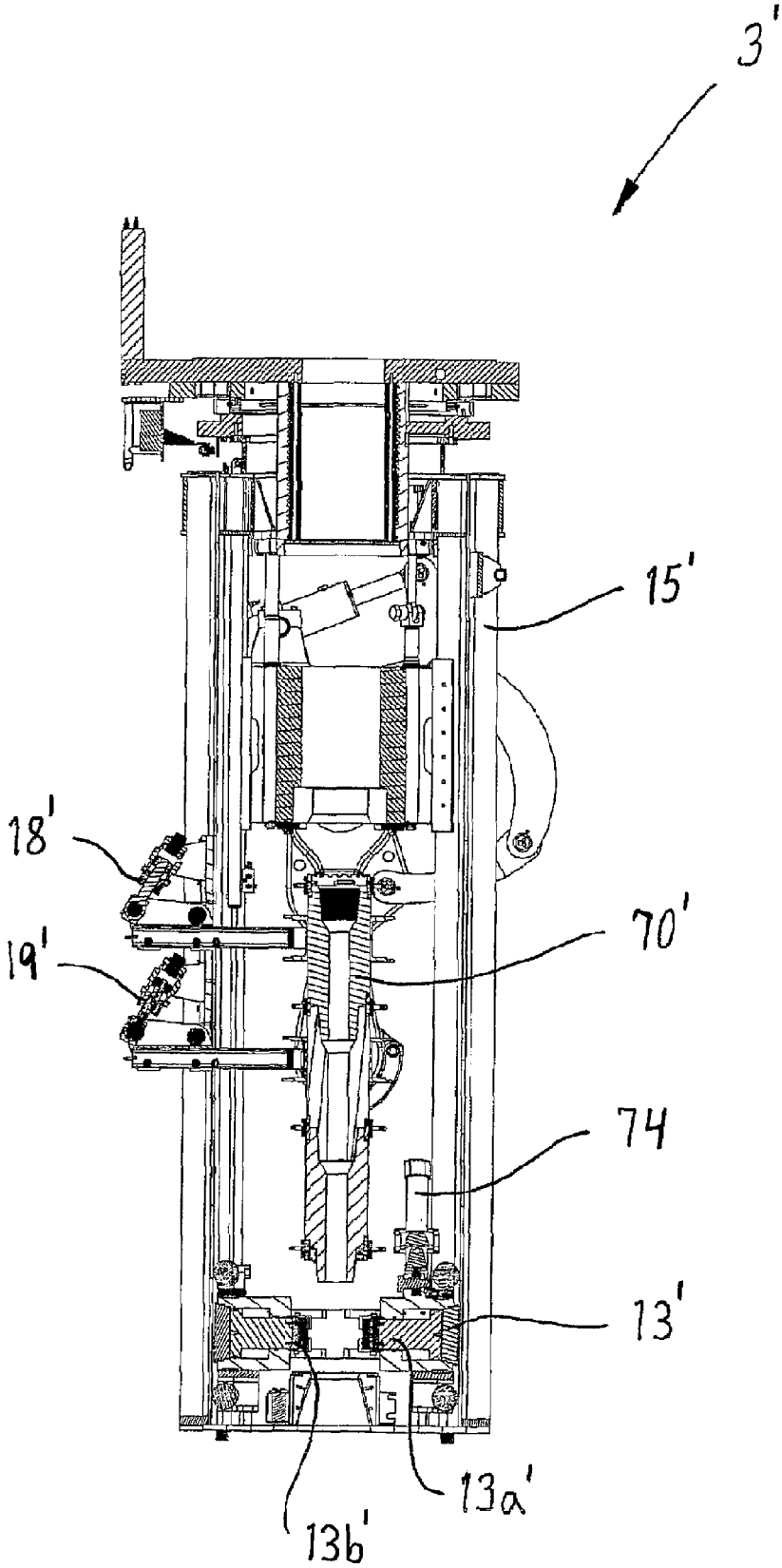
FIG. 26 shows an elevated view, partly in section, of the pipe handler apparatus.
Figure 27:
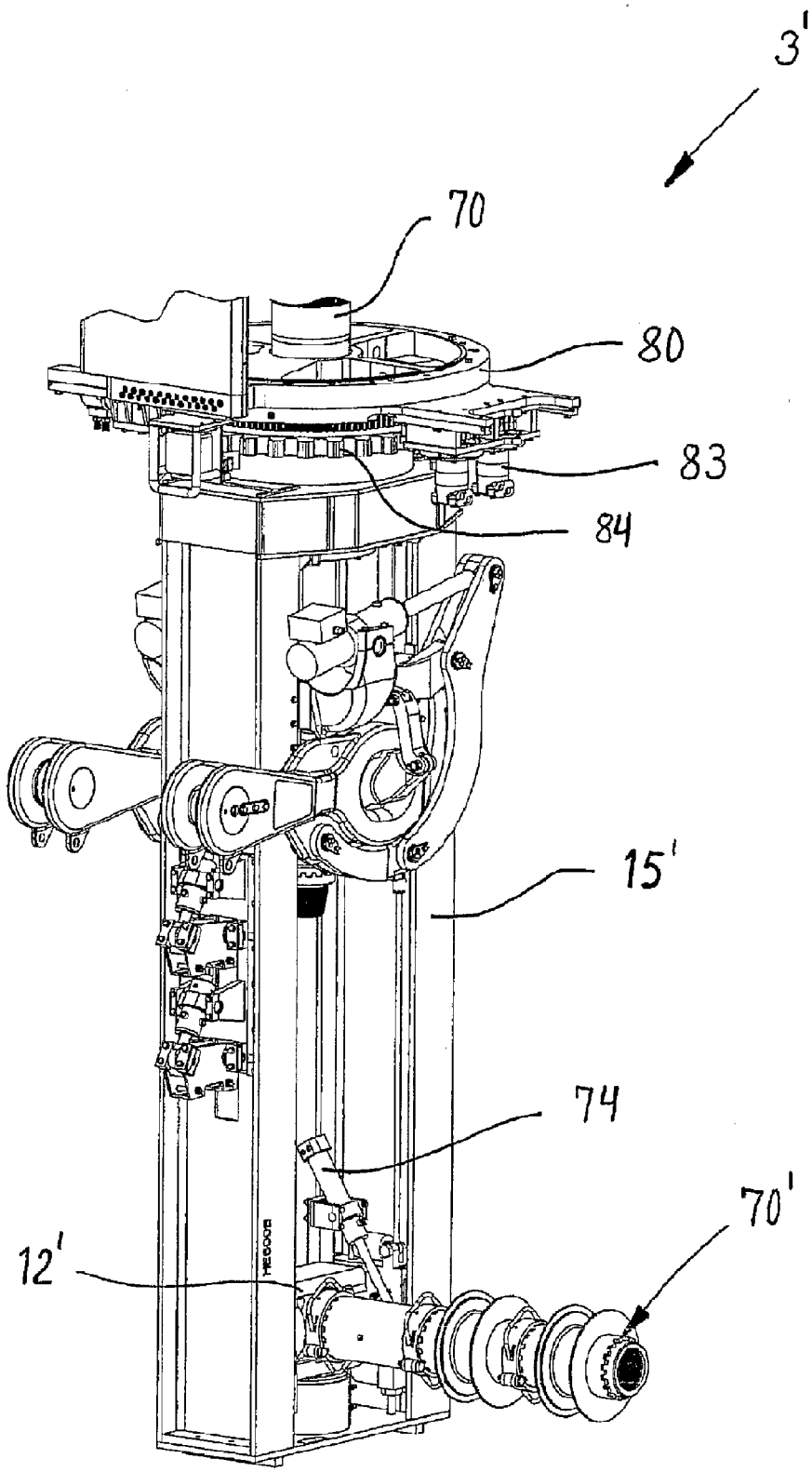
FIG. 27 shows another perspective view of the pipe handler apparatus and with the stub shaft outwards pivoted.
Figure 28:
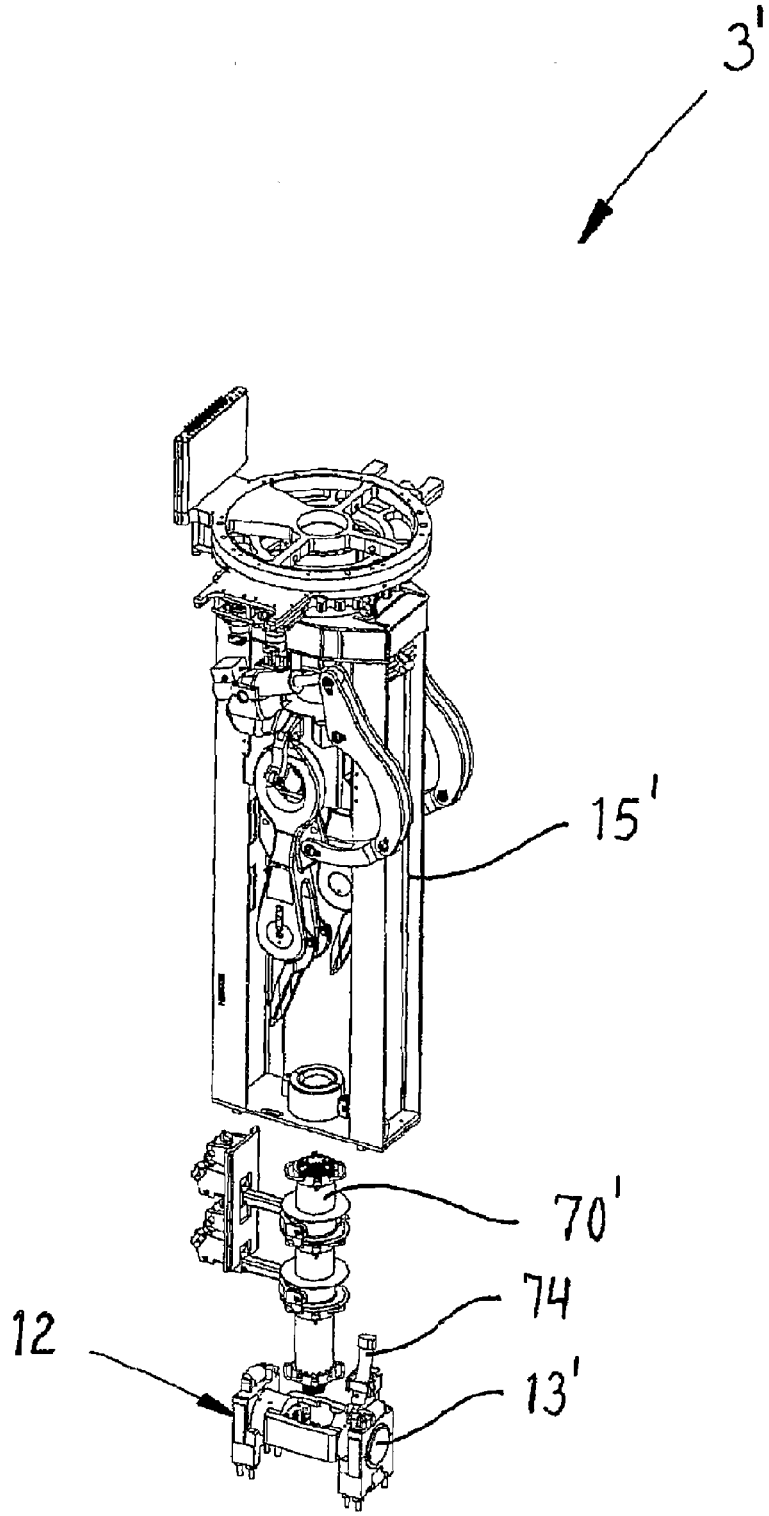
FIG. 28 shows a perspective view of the pipe handler apparatus with the parts separated from each other.

FIG. 24-28 show separately the entire pipe handling assembly 3'. The figures also show a torque arrestor with a clamping device 12' and two very heavy beams 15'. These beams 15' are heavy for two reasons, in part because they require great stiffness due to the torque that the wrench 12' is subjected to, in part because the beams 15' need to be heavy enough to take the entire weight of the drilling machine 10'. This, because an important part of the new technology is to be able to use the drawworks of the drilling vessel to perform heavy maintenance operations on the rig. The torque wrench 12', as shown in FIG. 26, includes two hydraulic cylinders 13*a*' and clamping dies 13*b*' that can act directly against a pipe part in order to keep it rotary stiff.

When a shaft stub 70' is to be replaced, a replacement sequence is initiated by clamping around the shaft stub 70' and associated valve set with a pipe clamping device 12'. Then the main motors 5' on the drilling machine 10' is used to set such a torque in the drive shaft 70 that the threaded connection between the drive shaft 70 and the shaft stub 70' is released. Then the entire shaft stub 70' and valve set is lowered by using a hydraulic hoisting means in such a way that the two redundant automatic operated valves as well as the manual emergency valve is lowered. From the vertical position as the pipe clamping device 12' initially has, the pipe clamping device 12' can be tilted by means of a working cylinder 74 about a pivotal point 13', see FIGS. 26 and 27. Thus the shaft stub 70' including the valves can be handled further by means of existing gear.

The well drilling apparatus 10' is, as mentioned, guided by a dolly 9' in its movements up and down the derrick. The dolly 9' includes a frame 9*d* that both horizontally and vertically adjustable wheel sets 9*a* are attached to. The wheels are running in rails that are mounted to the derrick. The wheel sets 9*a* are adjustable in order to be able to be adapted to different distances between the rails within the derrick. Normally one set of wheels 9*a* in each corner of the frame 9*d*.

The well drilling apparatus 10' is in turn attached to the frame 9*d* by four stays 9*e* which again can be activated by working cylinders or damping cylinders 9*f*. Each adjustable wheel set 9*a* is arranged on a bracket 9*b* that has a mounting surface designed for abutting an inclined surface 9*c* on the frame 9*d* of the dolly 9'. Each bracket 9*b* and thus each wheel set 9*a* are thus independently adjustable along the inclined surface 9*c*. When adjustment is performed, in order to adapt to the rail base, fixation of the bracket 9*b* to the frame 9*d* can be performed with suitable fixing means like screws, clamps or quick release coupling means.

TABLE 1

Prior art

| Module name | Transmission, swivel and main shaft 1 | Air cooling system | Connecting arms to traveling block 3 | Rotary seal 4 | Pipe handler assembly with shaft valve mechanism 5 | Dolly 6 | Hose and connecting manifold 7 | Main shaft valves 8 | Valve and instrument cabinet 9 | Motor 11 | Frequency converter unit 12 | Weight compensating system 14 | Environment 15 |
|---|---|---|---|---|---|---|---|---|---|---|---|---|---|
| Transmission, swivel and main shaft | | | | | | | | | | | | | |
| Air cooling system | X | | | | | | | | | | | | |
| Connecting arms to travelling block | X | | | | | | | | | | | | |
| Rotary seal | X | | | | | | | | | | | | |
| Pipe handler assembly with shaft valve mechanism | X | | | | | | | | | | | | |
| Dolly | X | | | | | | | | | | | | |
| Hose and connecting manifold | X | | | | | X | | | | | | | |
| Main shaft valves | X | | | | X | | | | | | | | |
| Valve and instrument cabinet | X | | | | | X | X | | | | | | |
| Motor | X | X | | | | | X | | X | | | | |
| Frequency converter unit | | | | | | | | | | | | | |
| Weight compensating system | X | | X | | | X | | | | | | | |
| Environment | | | X | | X | X | X | X | | | X | | |

TABLE 2

New machine

| Module name | Swivel and main shaft 1 | Power transmission 2 | Load frame 3 | Rotary seal 4 | Pipe handler assembly with shaft valve mechanism 5 | Dolly 6 | Hose and connecting manifold 7 | Main shaft valves 8 | Valve and instrument cabinet 9 | Instrument and in/out module for signals 10 | Motor 11 | Frequency converter unit 12 | Travelling block adapter 13 | Weight compensating system 14 | Environment 15 |
|---|---|---|---|---|---|---|---|---|---|---|---|---|---|---|---|
| Swivel and main shaft | | | | | | | | | | | | | | | |
| Power transmission | 1 | | | | | | | | | | | | | | |
| Load frame | 2 | 6 | | | | | | | | | | | | | |
| Rotary seal | 3 | | | | | | | | | | | | | | |
| Pipe handler assembly with shaft valve mechanism | 4 | 7 | | | | | | | | | | | | | |
| Dolly | | | 10 | | | | | | | | | | | | |
| Hose and connecting manifold | | | 11 | | | 18 | | | | | | | | | |
| Main shaft valves | 5 | | | | 16 | | | | | | | | | | |
| Valve and instrument cabinet | | 8 | 12 | | | | 21 | | | | | | | | |
| Instrument and in/out module for signals | | | | | | 19 | 22 | | 26 | | | | | | |
| Motor | | 9 | 13 | | | | 23 | | 27 | 28 | | | | | |
| Frequency converter unit | | | | | | | | | | | | | | | |
| Travelling block adapter | | | 14 | | | | | | | | | | | | |
| Weight compensating system | | | 15 | | | | | | | | | | 30 | | |
| Environment | | | | | 17 | 20 | 24 | 25 | | | | 29 | 31 | | |

The invention claimed is:

1. A top drive well drilling apparatus designed to be suspended from a travelling block in a drawworks and laterally supported by a dolly running together with the well drilling apparatus along tracks or rails attached to a derrick, said drilling apparatus comprising:

at least one driving motor, one power transmission powered by the at least one driving motor, a drive shaft driven from the power transmission and designed to be connected to a drill string, load transferring means, and a torque arresting device attached to and depending from the power transmission, wherein the load transferring means are in the form of a load frame that load relieves the drive shaft and the power transmission at the same time as it forms a central component which the other components are constructed around, and the torque arresting device comprises a clamping device that is able to retain a stub shaft which includes one or more valves, which shaft stub, while it is held stationary by the clamping device, is pivotal about a horizontal axis through the clamping device for laying down towards a horizontal position by means of a hydraulic cylinder.

2. A top drive well drilling apparatus according to claim 1, wherein the load frame is in the form of a structural element omitting any moving parts.

3. A top drive well drilling apparatus according to claim 1, wherein the load frame carries the power transmission where the power transmission constitutes a component which is releasable from the load frame by means of releasable connecting means.

4. A top drive well drilling apparatus according to claim 1, wherein the power transmission carries the at least one driving motor where each driving motor constitutes another component which is releasable from both the power transmission and the load frame by means of releasable connecting means.

5. A top drive well drilling apparatus according to claim 1, wherein the power transmission carries the torque arresting device that constitutes another component which is releasable from the transmission by means of releasable connecting means.

6. A top drive well drilling apparatus according to claim 1, wherein the connecting means are hydraulically operated bolts and nuts.

7. A top drive well drilling apparatus according to claim 1, wherein the connecting means are manually operated bolts and nuts.

8. A top drive well drilling apparatus according to claim 1, wherein the apparatus includes a swivel for transfer of mud or liquid from a stationary place to the rotating drill string, the swivel being connected to the drive shaft and forms together a swivel module that is releasable from the load frame by means of releasable connecting means.

9. A top drive well drilling apparatus according to claims 8, wherein the swivel is further connected to and in fluid communication with the drill string via the stub shaft, the stub shaft having at least one internal safety valve and also at least one redundant valve.

10. A top drive well drilling apparatus according to claim 1, wherein the apparatus includes a converting module for converting signals from analogue to digital format.

11. A top drive well drilling apparatus according to claim 1, wherein the apparatus includes an elevator mechanism having an elevator for manipulation of drill pipes/pipe string.

12. A top drive well drilling apparatus according to claim 1, wherein at least some of the components of the well drilling apparatus are designed, constructed and arranged as component modules, which by means of quick releasable connecting means connect the individual components/modules together.

13. A top drive well drilling apparatus according to claim 1, in combination with said dolly laterally supporting said dolly including horizontally and vertically adjustable wheel sets.

14. A top drive well drilling apparatus according to claim 13, wherein each adjustable wheel set is provided on a bracket having a mounting surface that is to be laid against an inclined surface on the frame of the dolly for adjustable fixation of the bracket to the frame.

15. A top drive well drilling apparatus according to claim 1, wherein the torque arresting device further comprises activating mechanisms for operation of said valves within the stub shaft.

* * * * *